US011452348B2

(12) United States Patent
Shute et al.

(10) Patent No.: US 11,452,348 B2
(45) Date of Patent: Sep. 27, 2022

(54) POLE APPARATUS, METHODS, AND SYSTEMS

(71) Applicant: G3 Genuine Guide Gear Inc., Burnaby (CA)

(72) Inventors: Cameron Allan Shute, Nelson (CA); Robbie Gordon Roberts, Port Moody (CA); Matthew Paul Taylor, Vancouver (CA); Michael Coletti, Vancouver (CA)

(73) Assignee: G3 Genuine Guide Gear Inc., Burnaby (CA)

( * ) Notice: Subject to any disclaimer, the term of this patent is extended or adjusted under 35 U.S.C. 154(b) by 0 days.

(21) Appl. No.: 17/071,837

(22) Filed: Oct. 15, 2020

(65) Prior Publication Data

US 2021/0106104 A1 Apr. 15, 2021

Related U.S. Application Data

(60) Provisional application No. 62/915,582, filed on Oct. 15, 2019.

(51) Int. Cl.
*A45B 9/02* (2006.01)
*A45B 9/04* (2006.01)
(Continued)

(52) U.S. Cl.
CPC ..... *A45B 9/02* (2013.01); *A45B 9/04* (2013.01); *A63C 11/222* (2013.01);
(Continued)

(58) Field of Classification Search
CPC ..... A63C 11/22; A63C 11/227; A63C 11/24; A45B 2009/005
See application file for complete search history.

(56) References Cited

U.S. PATENT DOCUMENTS 2,705,015 A 3/1955 Langlais
3,730,544 A * 5/1973 Hyman ..... A63C 11/22 280/819
(Continued)

FOREIGN PATENT DOCUMENTS

DE 102012104633 A1 12/2013
EP 1016435 A2 7/2000
(Continued)

OTHER PUBLICATIONS

Camp USA Inc., Xenon Trekking Poles, https://www.camp-usa.com/outdoor/product/trekking-poles/xenon/, available to public at least as early as Jun. 20, 2019, 3 pgs.
(Continued)

*Primary Examiner* — David R Dunn
*Assistant Examiner* — Danielle Jackson
(74) *Attorney, Agent, or Firm* — Kolisch Hartwell, P.C.

(57) ABSTRACT

One aspect of this disclosure is a pole apparatus. The pole apparatus may comprise a grip segment comprising a cord attachment surface; a pole segment; a tip segment and a cord extending between at least the pole segment and the tip segment. The grip segment, the pole segment, and the tip segment may be arrangeable in a side-by-side disposition. A portion of the cord extending between the pole segment and the tip segment may be positionable on the cord attachment surface in the side-by-side disposition. The grip segment may be removably attachable to the tip segment such that, when the portion of the cord is positioned on the cord attachment surface, the removable attachment of the grip segment to the tip segment may maintain the side-by-side disposition. Aspects of related apparatus, methods, and systems also are disclosed.

21 Claims, 23 Drawing Sheets

(51) Int. Cl.
*A63C 11/22* (2006.01)
*A63C 11/24* (2006.01)
*A45B 9/00* (2006.01)

(52) U.S. Cl.
CPC ..... *A63C 11/227* (2013.01); *A63C 11/24* (2013.01); *A45B 2009/002* (2013.01); *A45B 2009/005* (2013.01); *A45B 2009/007* (2013.01); *A45B 2200/05* (2013.01)

(56) References Cited

U.S. PATENT DOCUMENTS

| | | | | | |
|---|---|---|---|---|---|
| 3,866,931 | A * | 2/1975 | Marker | A63C 11/222 | 280/820 |
| 4,175,683 | A * | 11/1979 | Shields | A63C 11/22 | 280/814 |
| 4,247,132 | A * | 1/1981 | Shields | A63C 11/22 | 280/814 |
| 4,364,585 | A * | 12/1982 | Shields | A63C 11/025 | 280/814 |
| 4,493,494 | A * | 1/1985 | Feagin, Jr. | A63C 11/222 | 135/76 |
| 4,593,933 | A | 6/1986 | Nunno | | |
| 4,742,837 | A * | 5/1988 | Rise | A45B 9/00 | 135/66 |
| 5,056,820 | A | 10/1991 | Des Prez | | |
| 5,139,283 | A | 8/1992 | Dow et al. | | |
| 5,290,063 | A | 3/1994 | Lenhart | | |
| 5,312,134 | A * | 5/1994 | Goode | A41D 19/0037 | 2/160 |
| 5,443,287 | A | 8/1995 | Wells | | |
| 5,470,108 | A * | 11/1995 | Goode | A63C 11/222 | 135/75 |
| 5,516,150 | A * | 5/1996 | Goode | A41D 19/0037 | 2/161.1 |
| 5,941,435 | A | 8/1999 | Munro, III | | |
| 6,170,500 | B1 | 1/2001 | Turechek | | |
| 6,439,610 | B1 | 8/2002 | Pronzati | | |
| 6,749,227 | B2 | 6/2004 | Margid | | |
| 7,201,401 | B1 * | 4/2007 | Friedman | A63C 11/22 | 135/66 |
| 8,123,252 | B2 | 2/2012 | Lenhart | | |
| 8,297,870 | B2 | 10/2012 | Lenhart | | |
| 9,168,449 | B2 | 10/2015 | Lenhart et al. | | |
| 9,198,488 | B2 | 12/2015 | Pronzati et al. | | |
| 9,609,925 | B2 | 4/2017 | Lenhart | | |
| D798,699 | S | 10/2017 | Roiser | | |
| 9,974,366 | B2 * | 5/2018 | Heim | A45B 9/00 | |
| 10,286,289 | B2 * | 5/2019 | Owen | A63C 11/24 | |
| 10,492,577 | B2 * | 12/2019 | Ritter | A45B 9/04 | |
| 10,863,803 | B2 * | 12/2020 | Strum | A45B 9/04 | |
| 2007/0108756 | A1 | 5/2007 | Laakso et al. | | |
| 2011/0187092 | A1 | 8/2011 | Nickaes | | |
| 2013/0312797 | A1 * | 11/2013 | Lah | A45B 19/08 | 135/74 |
| 2015/0150344 | A1 | 6/2015 | Lenhart et al. | | |

FOREIGN PATENT DOCUMENTS

| | | | |
|---|---|---|---|
| EP | 2168641 | A1 | 3/2010 |
| WO | 2007060701 | A1 | 5/2007 |

OTHER PUBLICATIONS

Kogan, https://www.kogan.com/au/buy/hhh-1-piece-aonijie-e4070-e4093-tri-fold-folding-quick-lock-trekking-poles-hiking-pole-walking-stick-grey-115cm-e4070-66100308260091/, available to public at least as early as Jun. 20, 2019, 4 pgs.

Komperdell, Carbon FXP.4 Expedition Vario Compact, https://www.komperdell.com/en/Carbon-FXP.4-Expedition-Vario-Compact/K1942347-10-Tele, available to public at least as early as Jun. 20, 2019, 3 pgs.

Koraman, https://www.amazon.ca/KORAMAN-Trekking-Collapsible%EF%BC%8C1-Adjustable-Ultralight/dp/B07JQ13J4W, available to public at least as early as Jun. 20, 2019, 5 pgs.

Leii, https://www.leki.com/en_CA/touring/poles/?f=748%7C705%7C54, available to public at least as early as Jun. 20, 2019, 1 pg.

MEC, Black Diamond Carbon Compactor Poles, https://www.mec.ca/en/product/5054-850/Carbon-Compactor-Poles, available to public at least as early as Jun. 20, 2019, 3 pgs.

MEC, Black Diamond Alpine Z Pole Baskets, https://www.mec.ca/en/producV5042-704/Alpine-Z-Pole-Baskets? colour=NOC02 , available to public at least as early as Jun. 20, 2019 3 pgs.

MEC, Compactor Ski Poles, https://www.blackdiamondequipment.com/en_US/producVcompactor-ski-poles/, available to public at least as early as Jun. 20, 2019, 6 pgs.

MSR, DynaLock Ascent Carbon Backcountry Poles, https://www.msrgear.com/ca/poles/ascent-series/dynalock-ascent-carbon-backcountry-poles/dynalock-ascent-poles.html, available to public at least as early as Jun. 20, 2019, 6 pgs.

Trekology Trek-Z Trekking Hiking Poles, https://www.amazon.ca/Trekology-Trek-Z-Trekking-Hiking-Poles/dp/B07Q6BZQZC, available to public at least as early as Jun. 20, 2019, 10 pgs.

* cited by examiner

POLE APPARATUS, METHODS, AND SYSTEMS

RELATED APPLICATIONS

This application claims the benefit of U.S. Provisional Patent Application No. 62/915,582, filed Oct. 15, 2019, entitled "POLE APPARATUS, METHODS, AND SYSTEMS, the entirety of which is hereby incorporated by reference herein.

FIELD

This disclosure relates to exemplary pole apparatus, methods, and systems.

RELATED ART

When navigating various types of terrain, people may use different types of poles, including climbing poles, ski poles, and the like. Some ski poles, for example, may be transitioned between: (i) an extended configuration, in which the pole has an operating length for operating use, such as when skiing down a hill; and (ii) a collapsed configuration, in which the pole has a transit length that is shorter than the operating length, making it easier to stow and carry when not in operating use, such as when walking to the hill.

One type of expandable and collapsible pole is a "Z pole," in which a grip-containing portion of the pole, an interior portion of the pole, and a tip-containing portion of the pole may be arranged side-by-side in the collapsed configuration so that the transit length is less than the operating length. Maintaining the side-by-side disposition is a known problem for Z poles. Various additional attachment elements are sold with some Z poles to help solve this problem, such as bags or straps, but these additional elements often get damaged or lost over time.

SUMMARY

Numerous aspects are described in this disclosure. One exemplary aspect is a pole apparatus. For example, the pole apparatus may comprise: a grip segment comprising a cord attachment surface; a pole segment; a tip segment; and a cord extending between at least the pole segment and the tip segment. The grip segment, the pole segment, and the tip segment may be arrangeable in a side-by-side disposition. A portion of the cord extending between the pole segment and the tip segment may be positionable on the cord attachment surface in the side-by-side disposition. The grip segment may be removably attachable to the tip segment such that, when the portion of the cord is positioned on the cord attachment surface, the removable attachment of the grip segment to the tip segment may maintain the side-by-side disposition.

The pole segment may comprise a plurality of separable pole portions. The grip segment, the plurality of separable pole portions, and the tip segment may be arrangeable in the side-by-side disposition. The cord may comprise one or more cord segments extending between the grip segment, the pole segment, and the tip segment. The cord attachment surface may define a channel or groove configured to receive the portion of the cord. The grip segment may comprise a lateral extension and the cord attachment surface may be on the lateral extension. The cord attachment surface may extend across the lateral extension. The lateral extension may comprise a pair of retaining walls. The cord attachment surface may define a groove extending around a proximal end of the grip segment and between the pair of retaining walls.

The grip segment may comprise an extendable arm. The cord attachment surface may be on the extendable arm. The extendable arm may be rotatable to position the cord attachment surface to receive the portion of the cord. The grip segment may comprise a cavity and an extendable segment that is extendable from and retractable into the cavity. Retracting the extendable segment into the cavity may cause a rotation of the extendable arm that positions the cord attachment surface to receive the portion of the cord. The grip segment may comprise an extendable seat that is removably attachable to a distal end of the tip segment.

The tip segment may comprise a basket. The basket may be removably attachable to the grip segment. The basket may comprise a web structure defining an opening operable to receive a distal end of the grip segment. The web structure may be operable to limit a rotation of the tip segment relative to the grip segment when its distal end is received in the opening. The web structure may comprise a first magnetic element and the distal end of the grip segment may comprise a second magnetic element. The basket may be removably attachable to the grip segment using a magnetic interaction between the first magnetic element and the second magnetic element when the distal end of the grip segment is received in the opening.

The grip segment may comprise a first magnetic element and the tip segment may comprise a second magnetic element. A portion of the grip segment may be removably attachable to a portion of the tip segment using a magnetic force generated between the first magnetic element and the second magnetic element when the portion of the grip segment is positioned adjacent the portion of the tip segment. The portion of the tip segment may comprise a basket that is removably attachable to the portion of the grip segment by the magnetic force generated between the first magnetic element and the second magnetic element.

The grip segment may comprise a tip attachment surface, the tip segment may comprise a grip attachment surface, and the grip segment may be removably attachable to the tip segment by interlocking the tip attachment surface with the grip attachment surface. The grip segment may be removably attachable to the tip segment at different locations by interlocking one or both of a portion of the cord attachment surface with a distal end of the grip segment and a central portion of the grip segment with a central portion of the tip segment. A portion of the grip segment may be magnetically attachable to a portion of the tip segment when the tip attachment surface is interlocked with the grip attachment surface.

Another exemplary aspect is a method related to a pole apparatus, such as a method of maintaining the pole apparatus in a side-by-side disposition. For example, the method may comprise positioning the portion of the cord on the cord attachment surface and removably attaching the tip segment to the grip segment when the portion of the cord is positioned on the cord attachment surface. Removably attaching the tip segment to the grip segment may comprise interlocking a tip attachment surface of the grip segment with a grip attachment surface of the tip segment when the portion of the cord is positioned on the cord attachment surface. Removably attaching the tip segment to the grip segment also may comprise generating a magnetic force between a first magnetic element of the grip segment and a second magnetic element of the tip segment.

Aspects of related apparatus, methods, and systems also are described.

BRIEF DESCRIPTION OF THE DRAWINGS

The accompanying drawings, which are incorporated in and constitute part of this disclosure, illustrate exemplary aspects that, together with the written descriptions, serve to explain the principles of this disclosure. Numerous aspects are particularly described, pointed out, and taught in the written descriptions. Some structural and operation aspects may be even better understood by referencing the written portions together with the accompanying drawings, of which.

DETAILED DESCRIPTION

Figures 1, 1A:
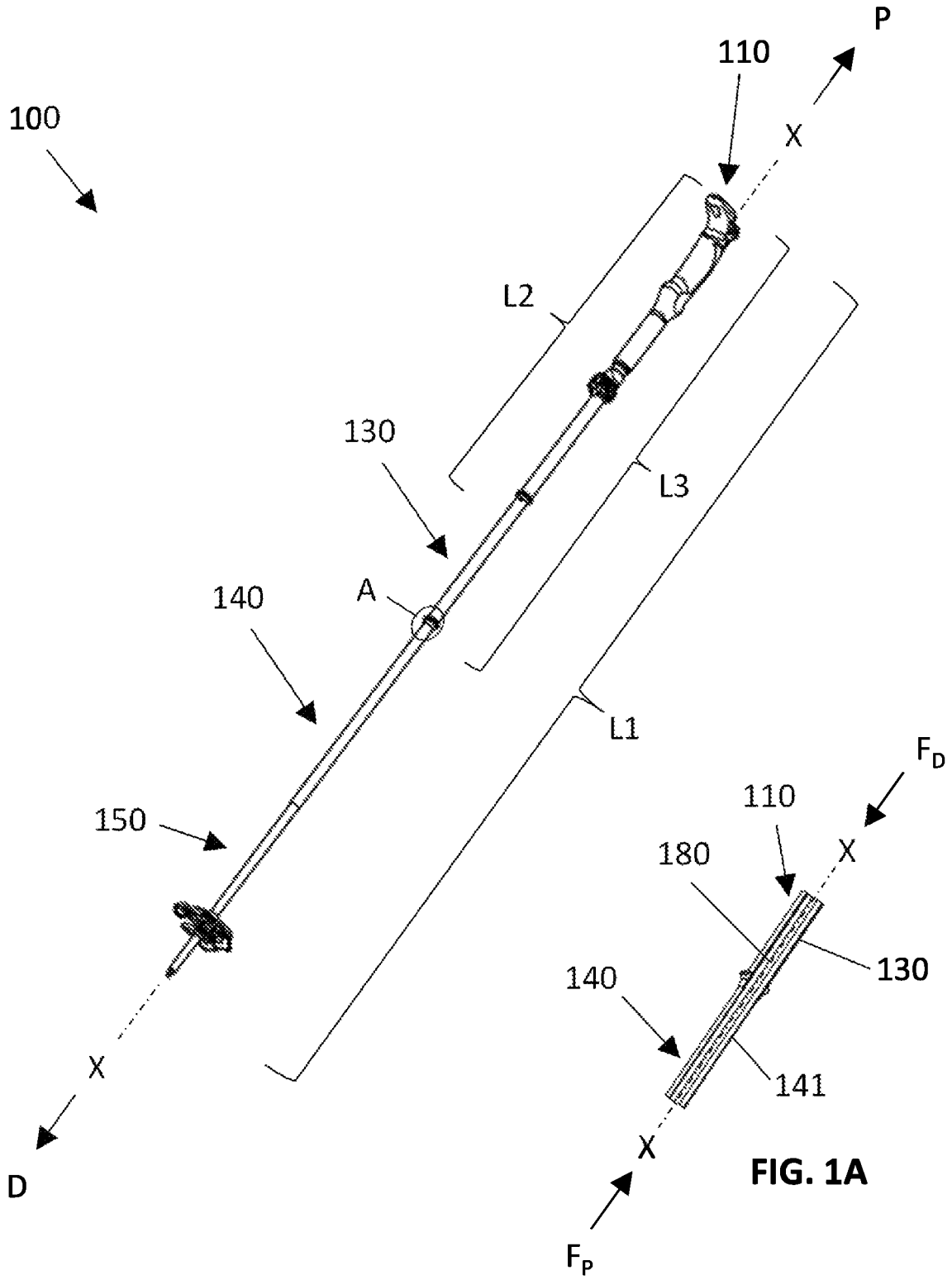
FIG. 1 depicts an exemplary pole in an expanded configuration and indicates a Section A.
FIG. 1A depicts a cross-section of the FIG. 1 pole at Section A, showing an exemplary cord extending through the pole.

Aspects of the present disclosure are not limited to the exemplary structural details and component arrangements described in the written descriptions and shown in the accompanying drawings. Many aspects of this disclosure may be applicable to other aspects and/or capable of being practiced or carried out in various variants of use, including those described herein.

Throughout the written descriptions, specific details are set forth in order to provide a more thorough understanding to persons of ordinary skill in the art. For convenience and ease of description, some well-known elements may be described conceptually to avoid unnecessarily obscuring the focus of this disclosure. In this regard, the written descriptions and accompanying drawings should be interpreted as illustrative rather than restrictive, enabling rather than limiting.

Aspects of this disclosure reference exemplary pole apparatus, methods, and systems. Some aspects are described with reference to collapsible poles (a.k.a., "Z poles") comprising various attachments and attachment surfaces. Unless claimed, these exemplary aspects are provided for convenience and not intended to limit the present disclosure. Accordingly, the concepts described in this disclosure may be utilized for any type of pole with any type of attachments.

The present disclosure references different exemplary axes, including: a longitudinal X-X axis, a lateral Y-Y axis, and a lateral axis Z-Z. Various elements are described with reference to these axes. For example, an element may be described as elongated or elongating with respect to any such axis, meaning that it has a length longer than a width along that axis. Longitudinal axis X-X and lateral axes Y-Y and Z-Z may be used to define relative arrangements of one element to another. For example, longitudinal axis X-X may be non-parallel with lateral axes Y-Y and/or Z-Z in some perspectives, meaning that axis X-X may extend across and/or intersect axes Y-Y and/or Z-Z.

Additional axes, directions, movements, and forces also may be described with reference to axes X-X, Y-Y, and/or Z-Z. For example, a proximal direction (or "P") and a distal direction (or "D") are located relative to longitudinal axis X-X in some of the accompanying drawings, in which "proximal" means situated nearer to a hand grip end along longitudinal axis X-X and further from a tip end along longitudinal axis X-X, and "distal" means situated further from the hand grip end along axis X-X and nearer the tip end along longitudinal axis X-X. Other anatomical directions may be similarly located relative to axes Y-Y and/or Z-Z. The axes and related terms are provided for convenience and non-limiting unless claimed.

As used herein, inclusive terms such as "comprises," "comprising," "includes," "including," and variations thereof, are intended to cover a non-exclusive inclusion, such that any pole apparatus, method, system, or element thereof, and comprising a list of elements does not include only those elements, but may include other elements not expressly listed and/or inherent thereto. Unless explicitly stated otherwise, the term "exemplary" is used in the sense of "example," rather than "ideal." Various terms of approximation may be used in this disclosure, including "approximately" and "generally." Approximately means "roughly" or within 10% of a stated number or outcome. Generally means "usually" or more than a 50% probability.

Terms such as "attachable," "attached," "attach," and the like are used in this disclosure to describe a connection between two or more elements. Such connections may be non-removable and/or non-movable, as when the two or more elements are formed together and cannot be moved and/or separated without damage. Such connections also may be removable and/or movable, as when the elements are coupled together by attachment elements (e.g., pins, screws, etc.) and/or structures (e.g., joints, hinges, etc.) that permit relative movements between and/or separation of the elements without damage. In some aspects, an element may be directly and removably attachable to another element, meaning that the elements may be coupled together without using attachment elements. Accordingly, unless a more specific term is used in the claims, the term attachable and its equivalents may comprise any such variations.

Aspects of this disclosure are now described in further detail with reference to an exemplary pole apparatus 100 including elements in the 100 series of numbers.

As shown in FIGS. 1 and 1A, pole apparatus 100 may comprise a grip segment 110, a pole segment 140, a tip segment 150, and a cord 180. These elements may be operable to transition pole apparatus 100 between an expanded configuration shown in FIG. 1 and a collapsed configuration shown in FIGS. 2 and 3. Pole apparatus 100 may be placed in the expanded configuration for operational use as a pole (e.g., a ski pole), in which grip segment 110, pole segment 140, and tip segment 150 may be arranged in an end-to-end disposition along a longitudinal axis X-X of apparatus 100 to define an extended length L1. Alternatively, pole apparatus 100 may be placed in the collapsed configuration for transit or storage, in which grip segment 110, pole segment 140, and tip segment 150 are arranged in a side-by-side disposition about longitudinal axis X-X to define a stowed length L2. As shown in FIG. 3, segments 110, 140, and 150 may be arranged in the side-by-side disposition along a lateral axis Z-Z that is non-parallel with axis X-X, or in other arrangements that may not necessarily be along one lateral axis.

Figure 2:
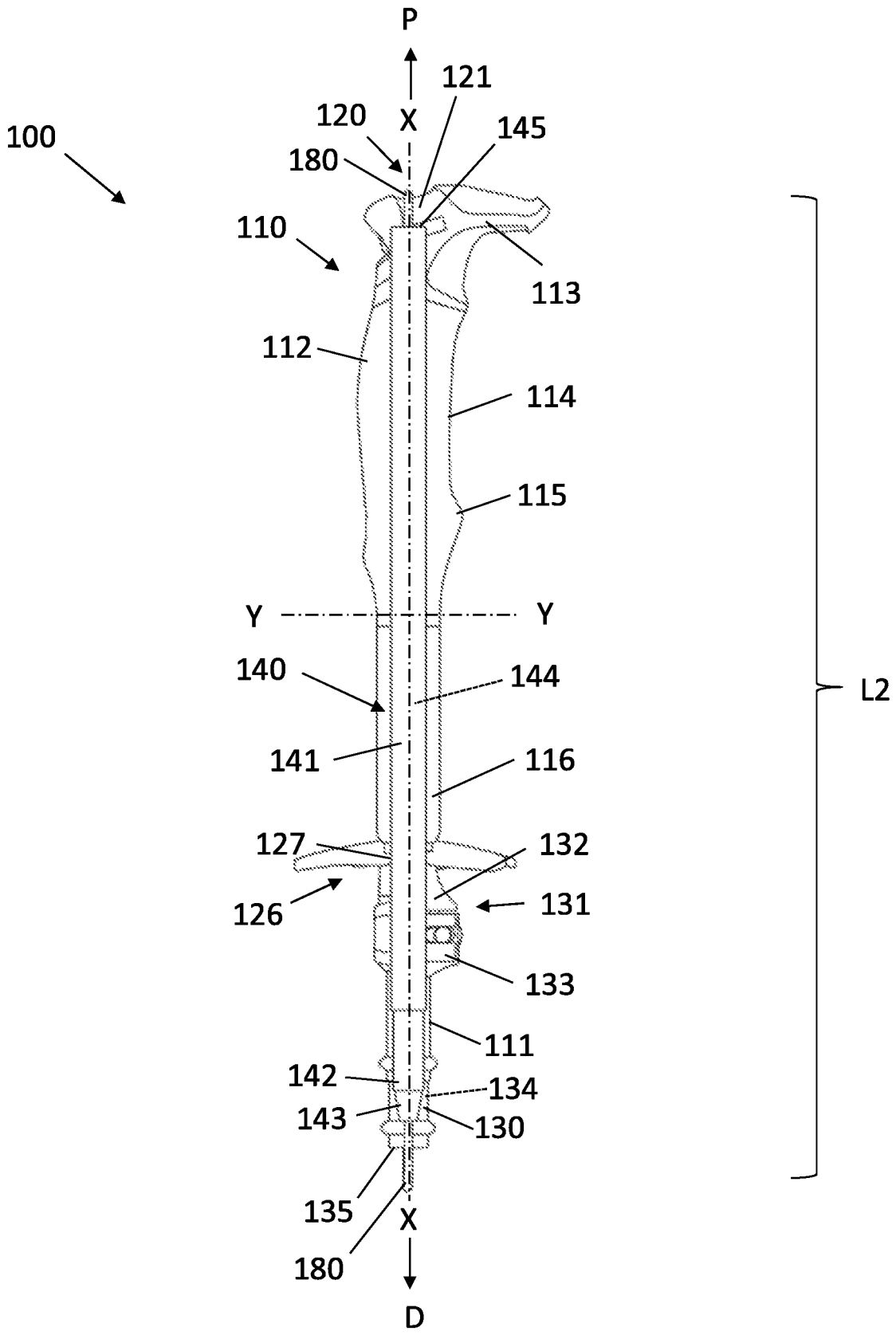
FIG. 2 depicts a side view of the FIG. 1 pole in a collapsed configuration.
Figure 3:
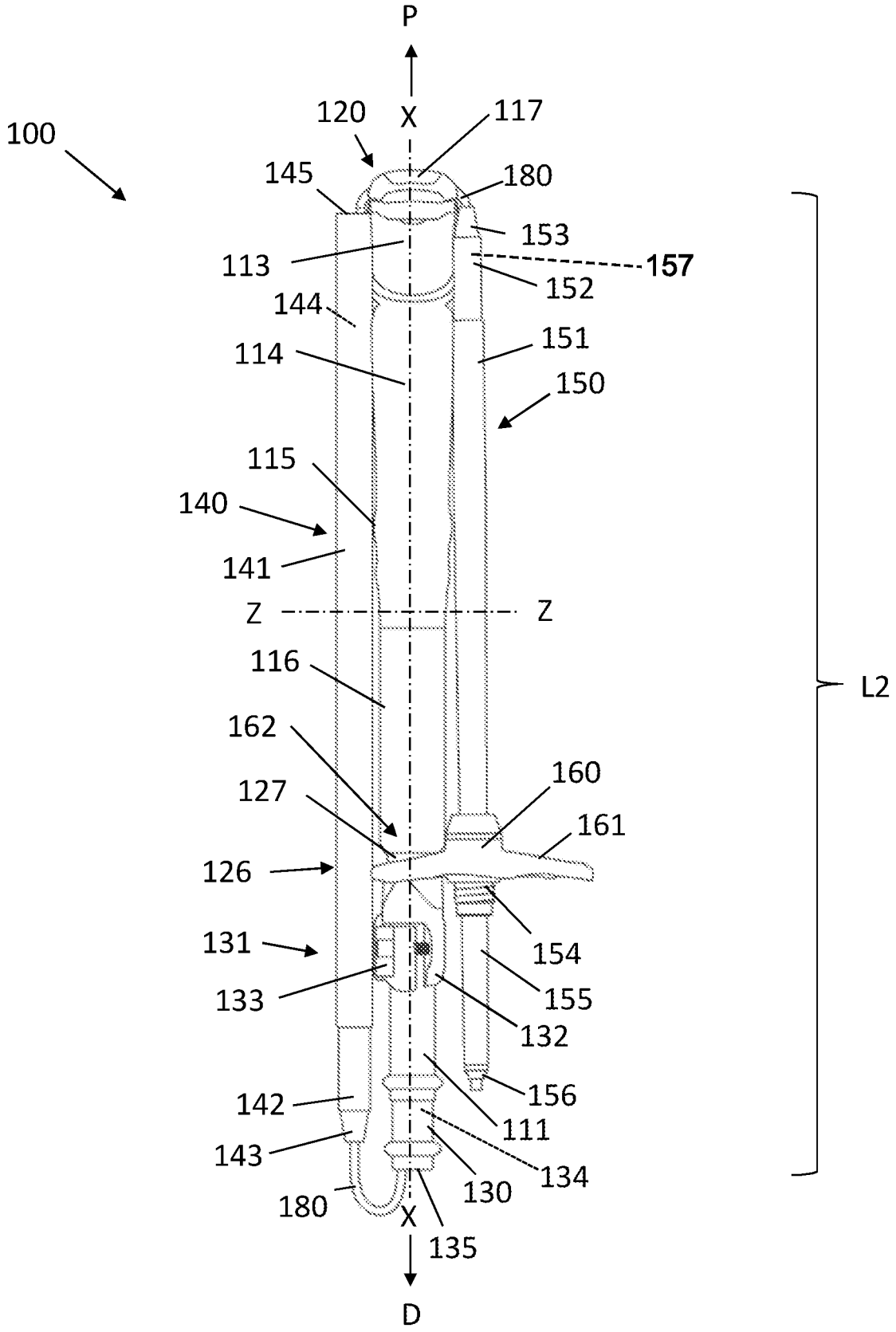
FIG. 3 depicts another side view of the FIG. 1 pole in the collapsed configuration.

As shown in FIG. 2, grip segment 110 may comprise a frame 111, a hand grip 112, a cord attachment portion 120, a tip segment attachment portion 126, an extendable section 130, and a cavity 134. As shown in FIGS. 2 and 3, each element of grip segment 110 may be arranged along longitudinal axis X-X and/or oriented relative to lateral axis Z-Z (e.g., as in FIG. 3) and/or a lateral axis Y-Y that is non-parallel with lateral axes X-X and Z-Z (e.g., as in FIG. 3).

Frame 111 may comprise a tube or other elongated structure that extends along longitudinal axis X-X between the distal and proximal ends of grip segment 110. Interior surfaces of hand grip 112 may be attached to exterior surfaces of frame 111 using an adhesive, a set of interlocking structures, and/or any equivalent or other means. Frame 111 and hand grip 112 may be composed of any material. For example, frame 111 may comprise a metallic material, such as aluminum, steel, and the like; and hand grip 112 may comprise a biocompatible material, such as rubber or silicon. Grip 112 also may comprise exterior surfaces having shapes and/or a coefficient of friction suitable for transferring forces from a hand (or glove).

Figure 4:
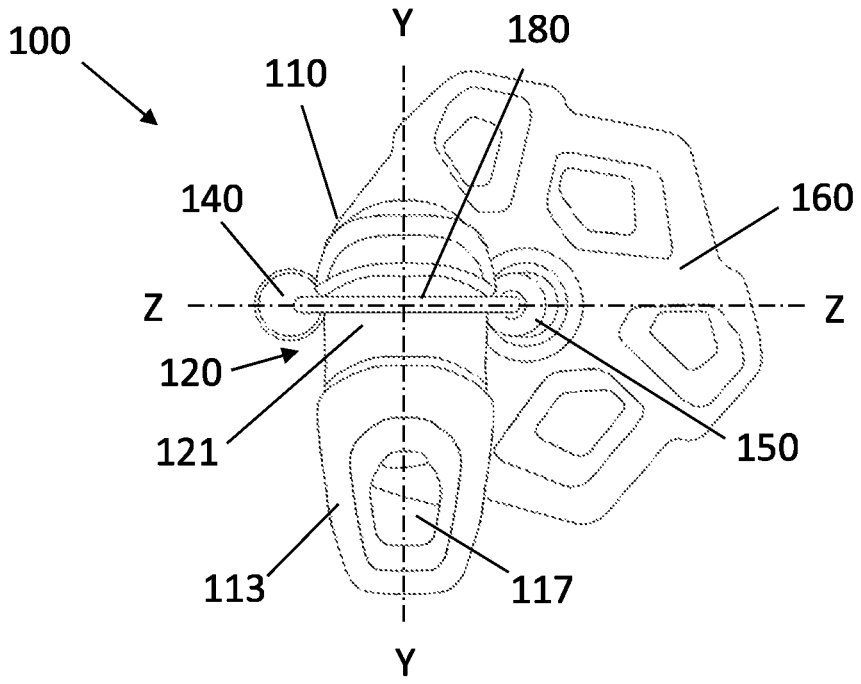
FIG. 4 depicts a top-down view of the FIG. 1 pole in the collapsed configuration.

Hand grip 112 may be configured to permit different grip types. One example is a "pistol grip" where exterior surfaces of hand grip 112 are graspable with the hand so that a radial-ulnar axis of the hand is generally aligned with longitudinal axis X-X and an anterior-posterior axis of the hand is generally aligned with lateral axis Y-Y, allowing digits of the hand to be wrapped around hand grip 112 about axis X-X so that interior surfaces of the digits are opposite of the palm along axis Z-Z. As shown in FIG. 2, hand grip 112 may comprise: (i) upper bolster surfaces 113 for upper digits of the hand; (ii) grip surfaces 114 for a palm of the hand; (iii) lower bolster surfaces 115 for lower digits of the hand; and (iv) additional grip surfaces 116 extending distally to from hand grip 112 for the palm and/or the digits. As shown in FIGS. 3 and 4, an opening 117 may extend through upper bolster surfaces 113 and be attachable to a belt or wrist strap.

Cord attachment portion 120 may be located on or adjacent hand grip 112. As shown in FIGS. 2 and 3, cord attachment portion 120 may be located at the proximal end of grip segment 110 and comprise one or more cord attachment surfaces 121 that are attachable with the portion of cord 180 when positioned on the one or more surfaces 121. In some aspects, the one or more cord attachment surfaces 121 may define structures that are directly and removably attachable to the portion of cord 180 when positioned thereon. For example, the one or more cord attachment surfaces 121 may comprise or define a channel, a groove, and/or any other structures configured to receive and/or retain the portion of cord 180 when positioned thereon, eliminating the need additional attachment elements such as bags or straps. Some or all of the one or more cord attachment surfaces 121 may be recessed from the exterior surfaces of hand grip 112. As shown in FIGS. 2 and 4, for example, the one or more cord attachment surfaces 121 may define a channel that is recessed into hand grip 112 along longitudinal axis X-X (e.g., as in FIG. 2) and extends across hand grip 112 in a direction generally parallel with lateral axis Z-Z (e.g., as in FIG. 4).

Figure 5:
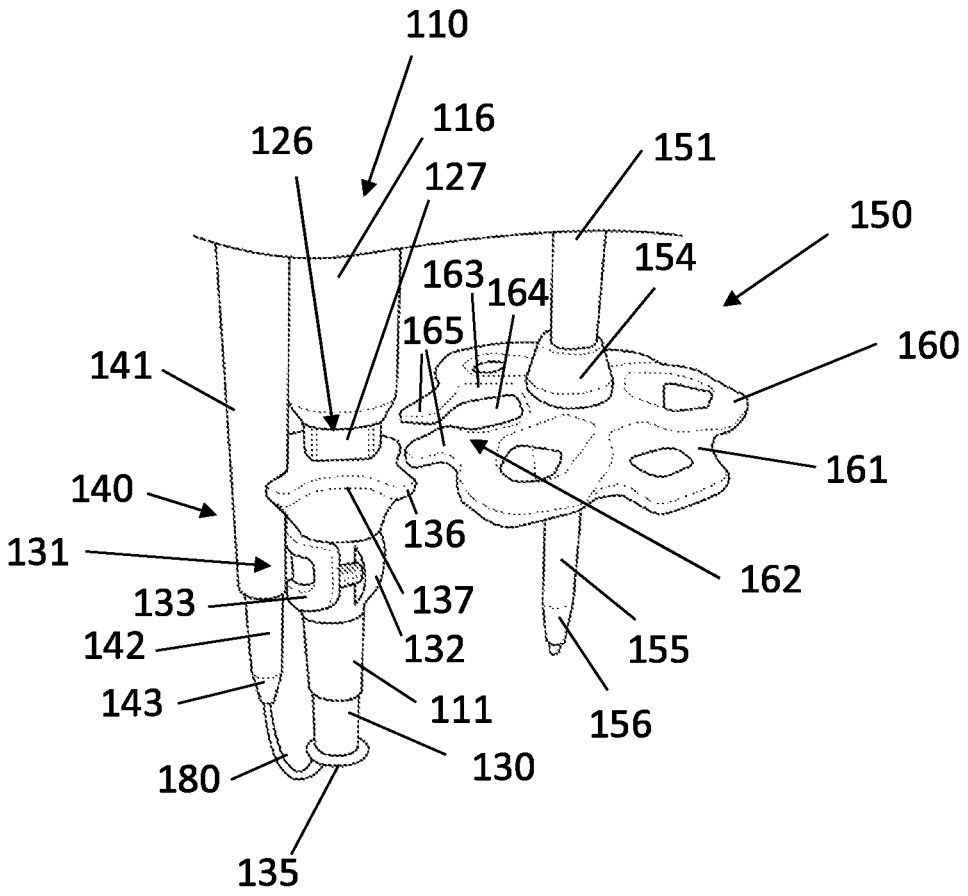
FIG. 5 depicts an exploded view of a distal end of the FIG. 1 pole in the collapsed configuration

Tip segment attachment portion 126 also may be located on or adjacent hand grip 112. As shown in FIGS. 2 and 3, tip segment attachment portion 126 may be located near a distal end of frame 111 and comprise one or more tip attachment surfaces 127 that are attachable with a corresponding set of one or more grip attachment surfaces on tip segment 150. In some aspects, the one or more tip attachment surfaces 127 may define structures that are directly and removably attachable to structures defined by the corresponding attachment surfaces of tip segment 150 without additional attachment elements. Similar to the one or more cord attachment surfaces 121, the one or more tip attachment surfaces 127 also may comprise or define a channel, a groove, and/or any other structures that are recessed from the exterior surfaces of hand grip 112. As shown in FIG. 5, the one or more tip attachment surfaces 127 may be disposed between and defined by a distal end of additional grip surfaces 116 described above and a proximal end of platform 132 described below.

As also shown in FIG. 5, additional grip surfaces 116 may comprise or define a circular cross-section about longitudinal axis X-X, the distal end of platform 132 may comprise a cross-shaped cross-section about axis X-X, and the one or more tip attachment surfaces 127 may comprise or define a rectangular cross-section about axis X-X. The rectangular cross-section of the one or more tip attachment surfaces 127 may comprise or define sidewalls extending along lateral axis Z-Z and end walls extending along lateral axis Y-Y. The sidewalls may comprise planar surfaces extending along axis Z-Z and the end walls may comprise curved surfaces extending outward from axis X-X. For example, tip segment attachment portion 126 may comprise a collar or sleeve that is mounted on frame 111, between additional grip surfaces 116 and platform 132, to define the one or more tip attachment surfaces 127.

As shown in FIG. 1, extendable section 130 of grip segment 110 may be operable to define an extended or operating length L3 of segment 110. As shown in FIG. 2, frame 111 may comprise a first tube extending along longitudinal axis X-X, section 130 may comprise a second tube extending along axis X-X, and the second tube may be telescopically receivable in the first tube along axis X-X.

Because of extendable section 130, grip segment 110 may be operable in: an extended configuration for operational use of pole apparatus 100, in which section 130 (e.g., the second tube) is extended out of frame 111 (e.g., the first tube) along longitudinal axis X-X to define extended length L3; and a retracted configuration for transit or storage of pole apparatus 100, in which the section 130 is retracted into frame 111 along axis X-X to define stowed length L2 with respect to a distal end of extendable section 130.

Extendable section 130 may comprise a locking mechanism 131 operable to maintain extended length L3 during operational use. As shown in FIGS. 2, 3, and 5, locking mechanism 131 may comprise a platform 132 mounted on frame 111 and a lever arm 133 that is rotatably mounted to platform 132. Lever arm 133 may be operable with platform 132 and/or frame 111 to maintain extended length L3 by preventing extendable section 130 from retracting into frame 111 along longitudinal axis X-X. For example, lever arm 133 may be rotated toward platform 132 to into a locked position where a contact portion of arm 133 makes physical contact with a reaction surface of frame 111 (e.g., a ledge or opening), causing an interference and/or friction fit between section 130 and frame 111 that maintains extended length L3. As a further example, lever arm 133 also may be rotated away from platform 132 into an unlocked position where the contact portion of arm 133 is spaced apart from the reaction surface of frame 111, allowing section 130 to move relative to frame 111 when transitioning between lengths L2 and L3.

Cavity 134 may extend at least partially through grip segment 110 along longitudinal axis X-X from an opening 135. As shown FIGS. 2 and 3, cavity 134 may extend through extendable section 130 and at least partially through frame 111. Opening 135 may be located on a distal end of extendable section 130 and configured to receive the proximal end of pole segment 140. For example, opening 135 may comprise a frustoconical shape configured to guide the proximal end of pole segment 140 into a distal portion of cavity 134 extending through section 130.

As shown in FIGS. 2, 3, and 5, pole segment 140 may comprise a frame 141 (e.g., another tube) extending along longitudinal axis X-X between the proximal and distal ends of pole segment 140. Similar to cavity 134 described above, a cavity 144 may extend through frame 141 along axis X-X. The proximal end of pole segment 140 (e.g., at bottom in FIGS. 2 and 3, where pole segment 140 is inverted) may be receivable in cavity 134 through opening 135. For example, the proximal end of pole segment 140 may comprise an extension 142; and a diameter of extension 142 may be smaller than a diameter of cavity 134 and opening 135, allowing extension 142 to be received in the distal portion of cavity 134 through opening 135. Extension 142 may comprise a conical tip 143 that tapers toward longitudinal axis X-X so that exterior surfaces of conical tip 143 may interact with interior surfaces of opening 135 to guide extension 142 into the distal portion of cavity 134. As also shown in FIGS. 2, 3, and 5, the distal end of pole segment 140 (e.g., at top in FIGS. 2 and 3, where segment 140 is inverted) may comprise an opening 145 in communication with cavity 144.

It is contemplated that pole apparatus 100 may comprise any number of pole segments 140 without department from this disclosure. For example, pole segment 140 may be divided into a plurality of separable pole portions, in which each separable portion may be similarly arrangeable in the end-to-end disposition shown in FIG. 1 and the side-by-side disposition shown in FIGS. 2 and 3.

As further shown in FIG. 3, tip segment 150 may comprise a frame 151 (e.g., another tube) extending along longitudinal axis X-X between the proximal end of tip segment 150 and a distal end of tip segment 150. The proximal end of tip segment 150 may be receivable in cavity 144 through opening 145. For example, the proximal end of frame 151 may comprise an extension 152 and a diameter of extension 152 may be smaller than a diameter of cavity 144 and opening 145, allowing extension 152 to be received in a distal portion of cavity 144 through opening 145. As shown in FIGS. 3 and 5, extension 152 may comprise a conical tip 153 that tapers toward longitudinal axis X-X so that exterior surfaces of tip 153 may interact with interior surfaces of opening 145 to guide extension 152 into cavity 144.

As shown in FIGS. 3 and 5, tip segment 150 may further comprise a basket coupler 154, a tip extension 155, a ground contact tip 156, and a basket 160. Basket coupler 154 may be mounted on frame 151 by any means (e.g., with an adhesive) and comprise one or more threads. Tip extension 155 may taper along longitudinal axis X-X from a central diameter of frame 151 towards the proximal end of tip segment 150. Ground contact tip 156 may be attached to tip extension 155. For example, ground contact tip 156 may comprise a rubber-like material with a proximal end mounted in tip extension 155 to resist proximally directed forces and a distal end configured to transfer forces to a ground surface (e.g., dirt, snow, etc.). As shown, ground contact tip 156 may comprise a conical structure that tapers along longitudinal axis X-X to allow for better penetration of the ground surface.

Basket 160 may be removably attached to basket coupler 154. In some aspects, basket 160 may be directly and removably attached to basket coupler 154. For example, basket 160 may comprise one or more threads configured to interact with the one or more threads of basket coupler 154, allowing basket 160 to be removably attached and thus easily replaced if broken during use. Basket 160 also may comprise a web structure 161 extending outwardly from basket coupler 154. As shown, web structure 161 may open proximally to define a catchment area for transferring forces to and from the ground surface. The catchment area may be generally circular and/or coaxial with longitudinal axis X-X. For example, web structure 161 may be configured so that the catchment area comprises a semi-spherical shape that opens proximally along axis X-X to transfer forces to a particular type of ground surface, such as snow. As a further example, structure 161 may comprise beam elements configured to resist deformations of basket 160 caused by proximally directed reaction forces applied thereto by the snow.

Tip segment 150 may comprise a grip segment attachment portion 162 that is located a proximal end of tip segment 150. As shown in FIG. 5, grip segment attachment portion 162 may be located on or adjacent basket 160 and comprise one or more grip attachment surfaces 163 that are attachable with a portion of grip segment 110, such as the one or more tip attachment surfaces 127 of tip segment attachment portion 126. In some aspects, the one or more grip attachment surfaces 163 may define structures that are directly and removably attachable with structures defined by the one or more tip attachment surfaces 127 without additional attachment elements. For example, the one or more grip attachment surfaces 163 may be defined by web structure 161 of basket 160 to include an attachment opening 164 extending through basket 160. As shown in FIG. 5, attachment opening 164 may have a cross-section corresponding with a cross-section of the one or more tip attachment surfaces 127 of tip segment attachment portion 126. For example, attachment opening 164 may comprise a rectangular cross-section that is slightly larger than the rectangular cross section of the one or more tip attachment surfaces 127, allowing the one or more tip attachment surfaces 127 to be received in opening 164.

Web structure 161 may be configured to secure the one or more tip attachment surfaces 127 in attachment opening 164. As shown in FIG. 5, web structure 161 may comprise arms 165 that deflect away from longitudinal axis X-X to receive the one or more tip attachment surfaces 127 in attachment opening 164 along lateral axis Y-Y and rebound toward axis X-X to secure surfaces 127 in attachment opening 164. As a further example, each arm 165 (or another portion of web structure 161) also may secure the rectangular cross-section of surfaces 127 in the rectangular cross-section of opening 164 by snapping behind an end wall of surfaces 127.

Cord 180 may extend between grip segment 110, pole segment 140, and tip segment 150. A proximal end of cord 180 may be attached to grip segment 110 (e.g., with interior surfaces of cavity 134), a middle portion of cord 180 may extend through cavity 144 of pole segment 140, and a distal end of cord 180 may be attached to tip segment 150 (e.g., with interior surfaces of cavity 157). In this example, tensile forces applied by cord 180 may be transferred directly to grip segment 110 and tip segment 150 through their respective attachments with cord 180, and indirectly to pole segment 140 through the respective distal and proximal ends of segments 110 and 150. Cord 180 may comprise one section or a plurality of separate sections. For example, cord 180 also may comprise a proximal portion attached to segments 110 and 140 and a distal portion attached to segments 140 and 150. Cord 180 may comprise any type of elastic material configured to apply the tensile forces. For example, cord 180 may comprise one or more elastic cords made of a natural rubber or a synthetic rubber in any configuration, including any combination of fabric or textile cords and cord materials. Cord 180 also may comprise any type of non-elastic material configured to apply the tensile forces. For example, cord 180 also may comprise any number of cables and/or chains that are made of a less resilient material (e.g., less than rubber, such as metal) and/or comprise or are operable with a resilient element (e.g., a spring) configured to apply the tensile forces. Alternative embodiments may include more than one cord 180 made of any such materials.

For example, in keeping with the above, an embodiment of pole apparatus 100 may comprise: a grip segment 110 comprising hand grip 112 and cord attachment portion 120 on or adjacent hand grip 112; one or more pole segments 140; tip segment 150 comprising basket 160 and grip segment attachment portion 162 on or adjacent basket 160; and cord 180 extending between grip segment 110, the one or more pole segments 140, and tip segment 150. In this embodiment, pole apparatus 100 may be operable between: (A) the extended configuration shown in FIG. 1, in which (i) grip segment 110, the one or more pole segments 140, and tip segment 150 are arranged in an end-to-end disposition, and (ii) cord 180 is operable to maintain the end-to-end disposition; and (B) the collapsed configuration shown in FIGS. 2 and 3, in which (i) grip segment 110, the one or more pole segments 140, and tip segment 150 are arranged in a side-by-side disposition, (ii) a portion of cord 180 is attached to cord attachment portion 120, (iii) a portion of grip segment 110 is attached to grip segment attachment portion 162, and (iv) cord 180 element is operable to maintain the side-by-side disposition.

As a further example, also in keeping with above, another embodiment of pole apparatus 100 may comprise: grip segment 110 comprising a cord attachment surface 121; pole segment 140; tip segment 150; and a cord 180 extending between at least pole segment 140 and tip segment 150, wherein: (A) grip segment 110, pole segment 140, and tip segment 150 are arrangeable in a side-by-side disposition; (B) a portion of cord 180 extending between pole segment 140 and tip segment 150 is positionable on cord attachment surface 121 in the side-by-side disposition; and (C) grip segment 140 is removably attachable to tip segment 150 such that when the portion of cord 180 is positioned on cord attachment surface 121, removable attachment of grip segment 140 to tip segment 150 maintains the side-by-side disposition.

In either of these exemplary embodiments, the side-by-side disposition of grip segment 110, pole segment 140, and tip segment 150 may be at least partially maintained by tensile forces applied by cord 180, without need for additional attachment elements such as bags or straps. In some aspects, the tensile forces applied by cord 180 may be operable to maintain both the end-to-end disposition of segments 110, 140, and 150 in the expanded configuration of pole apparatus 100 shown in FIG. 1, and the side-by-side disposition of segments 110, 140, and 150 in collapsed configuration of apparatus 100 shown in FIGS. 2 and 3. To more clearly describe the capabilities of cord 180, an exemplary assembly method 200 for transitioning pole apparatus 100 into the expanded configuration of FIG. 1 is now described. For convenience, aspects of method 200 are described with reference to apparatus 100, although similar aspects also may be described with reference to apparatus 400, 500, 600, 700, 800, and/or 900 described below.

Figure 24:
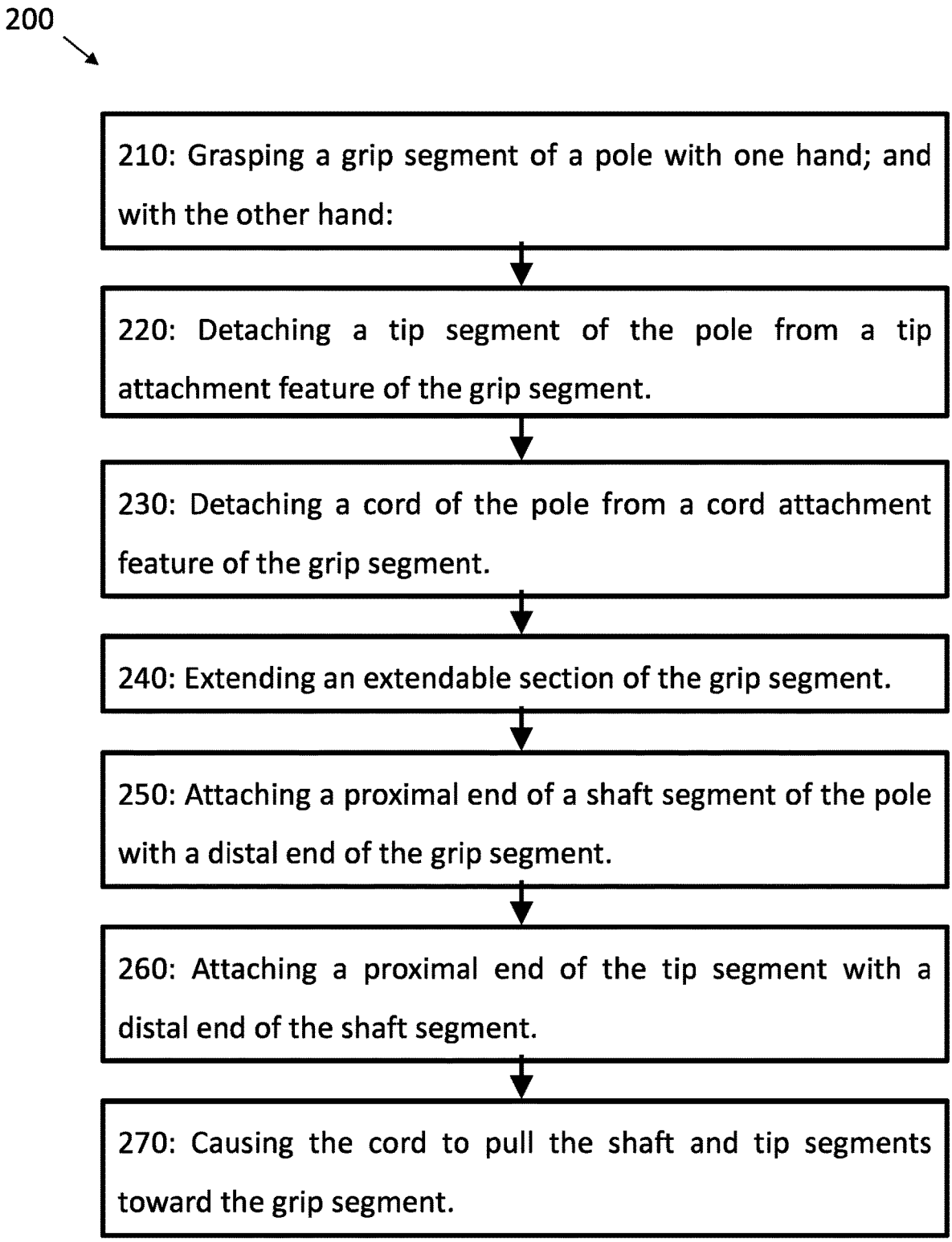
FIG. 24 depicts an exemplary assembly method.

As shown in FIG. 24, assembly method 200 may comprise: (a) grasping grip segment 110 with one hand (a "grasping step 210"); and, with other hand: (b) detaching grip segment attachment portion 162 of tip segment 150 from tip segment attachment portion 126 of grip segment 110 (a "detaching step 220"); (c) detaching the portion of cord 180 from cord attachment portion 120 of grip segment 110 (a "detaching step 230"); (d) extending extendable section 130 (an "extending step 240"); (e) attaching the proximal end of pole segment 140 with the distal end of grip segment 110 (an "attaching step 250"); (f) attaching the proximal end of tip segment 150 with the distal end of pole segment 140 (an "attaching step 260"); and (g) causing cord 180 to pull pole segment 140 and tip segment 150 toward grip segment 110 (a "causing step 270").

Grasping step 210 may be performed with any surface of hand grip 112. Detaching step 220 may comprise moving tip segment 150 away from grip segment 110 along lateral axis Z-Z until the one or more tip attachment surfaces 127 are removed from attachment opening 164. Detaching step 230 may comprise moving tip segment 150 relative to grip segment 110 about lateral axis Y-Y until the portion of cord 180 is removed from the one or more cord attachment surfaces 121. Extending step 240 may comprise maintaining length L3 by extending extendable section 130 out of frame 111 and operating locking mechanism 131. Attaching steps 250 and 260 may comprise aligning grip segment 110 with segments 140 and 150 along axis X-X. And causing step 270 may comprise releasing segments 140 and 150 with the other hand so that tensile forces applied by cord 180 may act against segments 110 and 150 to maintain the end-to-end disposition.

Once assembly method 200 has been performed, cord 180 may be operable to maintain the end-to-end disposition of segments 110, 140, and 150 by continuously applying the tensile forces that pull pole segment 140 and tip segment 150 toward grip segment 110 along longitudinal axis X-X. As shown in FIG. 1A, cord 180 may have a fully contracted, equilibrium length that is smaller than lengths L1, L2, and L3 (e.g., as shown in FIG. 1) so that the tensile forces applied thereby comprise a proximally directed tensile force $F_P$ and a distally directed tensile force $F_D$ that constantly pull segments 110, 140, and 150 toward one another along axis X-X when pole apparatus 100 is in the expanded configuration. The respective ends of segments 110, 140, and/or 150 may be further configured to maintain the end-to-end disposition. For example, the respective extensions 142 and 152 at the proximal ends of segments 140 and 150 may be receivable in respective distal portions of cavities 134 and 144 so that exterior surfaces of the extensions 142, 152 may act against interior surfaces of cavities 134, 144 to better resist against forces applied thereto during use.

To even further describe the capabilities of cord 180, an exemplary disassembly method 300 for transitioning pole apparatus 100 into the collapsed configuration of FIGS. 2 and 3 is now described. Again for convenience, aspects of method 300 are described with reference to apparatus 100, although similar aspects also may be described with reference to apparatus 400, 500, 600, 700, 800, and/or 900 described below.

Figure 25:
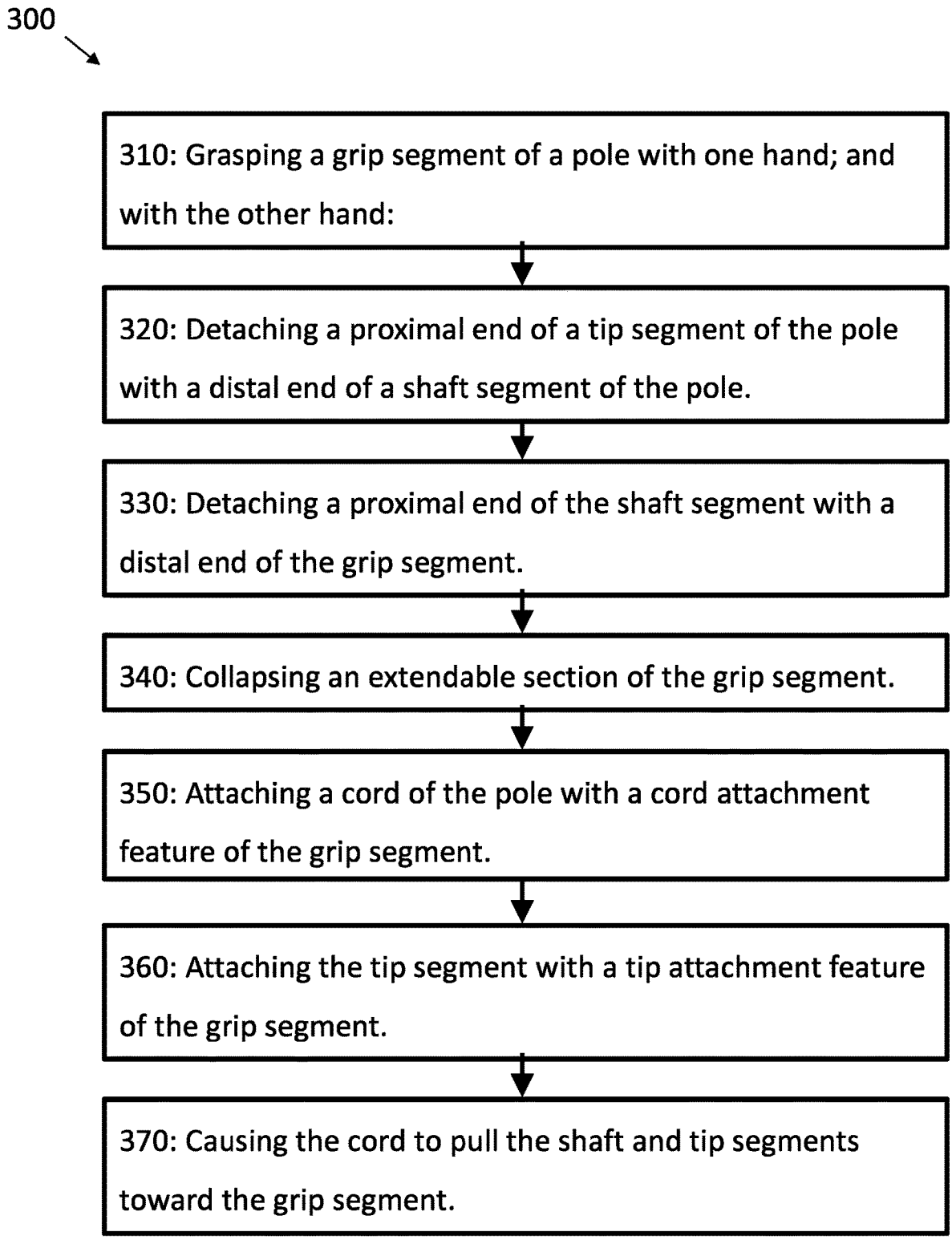
FIG. 25 depicts an exemplary disassembly method.

As shown in FIG. 25, disassembly method 300 may comprise: (a) grasping segment 110 with one hand (a "grasping step 310"); and, with other hand: (b) detaching the proximal end of tip segment 150 from the distal end of pole segment 140 (an "detaching step 320"); (c) detaching the proximal end of pole segment 140 from the distal end of grip segment 110 (an "detaching step 330"); (d) collapsing extendable section 130 (a "collapsing step 340"); (e) attaching the portion of cord 180 with cord attachment portion 120 of grip segment 110 (an "attaching step 350"); (f) attaching grip segment attachment portion 162 of tip segment 150 with tip segment attachment portion 126 of grip segment 110 (an "attaching step 360") and (g) causing cord 180 to pull pole segment 140 and tip segment 150 toward grip segment 110 (a "causing step 370").

Grasping step 310 may again be performed with any surfaces of hand grip 112. Detaching step 320 may comprise moving pole segment 140 distally along longitudinal axis X-X until the proximal end of segment 140 is detached from the distal end of segment 110. Detaching step 330 may comprise moving segment 150 distally along axis X-X until the distal end of segment 140 is detached from the proximal end of segment 150. Collapsing step 340 may comprise maintaining length L2 by collapsing extendable section 130 into frame 111 and operating locking mechanism 131. Attaching step 350 may comprise moving tip segment 150 relative to grip segment 110 about lateral axis Y-Y until the portion or cord 180 is positioned on the one or more cord attachment surfaces 121. For example, in step 350, the portion of cord 180 may be positioned in or relative to a structure defined by the one or more cord attachment surfaces 121 (e.g., a channel or groove) to attach the portion of cord 180 to the one or more surfaces 121 without using any additional attachment elements. Attaching step 360 may comprise moving tip segment 150 toward from grip segment 110 along lateral axis Z-Z until the one or more tip attachment surfaces 127 are located in attachment opening 164. For example, in step 360, grip segment 110 may be directly and removably attached to tip segment 150 without using any additional attachment elements. Causing step 370 may comprise releasing segments 140 and 150 with the other hand so that tensile forces applied by cord 180 may act against segment 110 to maintain the side-by-side disposition by pulling segments 140 and 150 toward segment 110 along axis Z-Z.

Once disassembly method 300 has been performed, cord 180 may be operable to maintain the side-by-side disposition of segments 110, 140, and 150 by continuously applying the tensile forces to pull pole segment 140 and tip segment 150 toward grip segment 110 along lateral axis Z-Z. For example, in keeping with FIG. 1A, cord 180 may have a fully contracted, equilibrium length that is smaller than lengths L1, L2, and L3 (e.g., as shown in FIG. 1) so that the tensile forces $F_P$ and $F_D$ are constantly pulling segments 140 and 150 toward segment 110 along axis Z-Z when apparatus 100 in the collapsed configuration.

Accordingly, when (A) the portion of cord 180 is attached (e.g., directly and removably) to cord attachment portion 120 and (B) grip segment attachment portion 162 is attached to tip segment attachment portion 126, then (C) the tensile forces applied by cord 180 may act against attachments 120 and 126 to simultaneously and continuously pull: (i) the proximal end of pole segment 140 toward opening 135; (ii) the distal end of pole segment 140 toward cord attachment portion 120; and (iii) the proximal end of tip segment 150 toward attachment portion 120 along axis Z-Z. Put another way, because of the above-described configurations of attachment portions 120, 126, and 162, the tensile forces applied by cord 180 in the collapsed configuration of pole apparatus 100 may be more effectively redirected to cinch segments 110, 140, and 150 together, making apparatus 100 smaller and thus easier to transport or store.

Other aspects of pole apparatus 100 also may help to maintain the side-by-side disposition of segments 110, 140, and 150 when pole apparatus 100 is in the collapsed configuration. As shown in FIGS. 2, 4, and 5, the one or more cord attachment surfaces 121 may be aligned with (e.g., centered on) longitudinal axis X-X so that pole segment 140 and tip segment 150 may be generally aligned or even parallel with axis X-X when side-by-side with segment 110, allowing the tensile forces applied by cord 180 to be redirected along axis X-X. As shown in FIG. 5, platform 132 may comprise a shaft retaining portion 136 configured to align pole segment 140 with grip segment 110. For example, a cross-section of shaft retaining portion 136 about longitudinal axis X-X may comprise a cross- or star-shaped cross-sectional shape defining one or more valleys 137 configured to receive pole segment 140 (e.g., prior to attaching step 350) and limit rotations of segment 140 relative to axis X-X when apparatus 100 is in the collapsed configuration.

Other aspects of pole apparatus 100 also may help to maintain the side-by-side disposition of segments 110, 140, and 150 when pole apparatus 100 is in the collapsed configuration. As shown in FIGS. 2, 4, and 5, the one or more cord attachment surfaces 121 may be aligned with (e.g., centered on) longitudinal axis X-X so that pole segment 140 and tip segment 150 may be generally aligned or even parallel with axis X-X when side-by-side with segment 110, allowing the tensile forces applied by cable cord 180 to be redirected along axis X-X. As shown in FIG. 5, platform 132 may comprise a shaft retaining portion 136 configured to align pole segment 140 with grip segment 110. For example, a cross-section of shaft retaining portion 136 about longitudinal axis X-X may comprise a cross- or star-shaped cross-sectional shape defining one or more valleys 137 configured to receive pole segment 140 (e.g., prior to attaching step 350) and limit rotations of segment 140 relative to axis X-X when apparatus 100 is in the collapsed configuration.

Additional aspects of this disclosure are now described with reference to exemplary pole apparatus 400, 500, 600, 700, 800, and 900, each including elements in the respective 400, 500, 600, 700, 800, or 900 series of numbers that are counterparts to or variations of the elements of apparatus 100 in the 100 series. Differences between the elements of pole apparatus 100 and varied elements of pole apparatus 400, 500, 600, 700, 800, and/or 900 are now described. Aspects described with reference to a particular apparatus 100, 400, 500, 600, 700, 800, and/or 900 may be used interchangeably with any other apparatus described herein, each combination and/or potential iteration being part of this disclosure.

Figure 6:
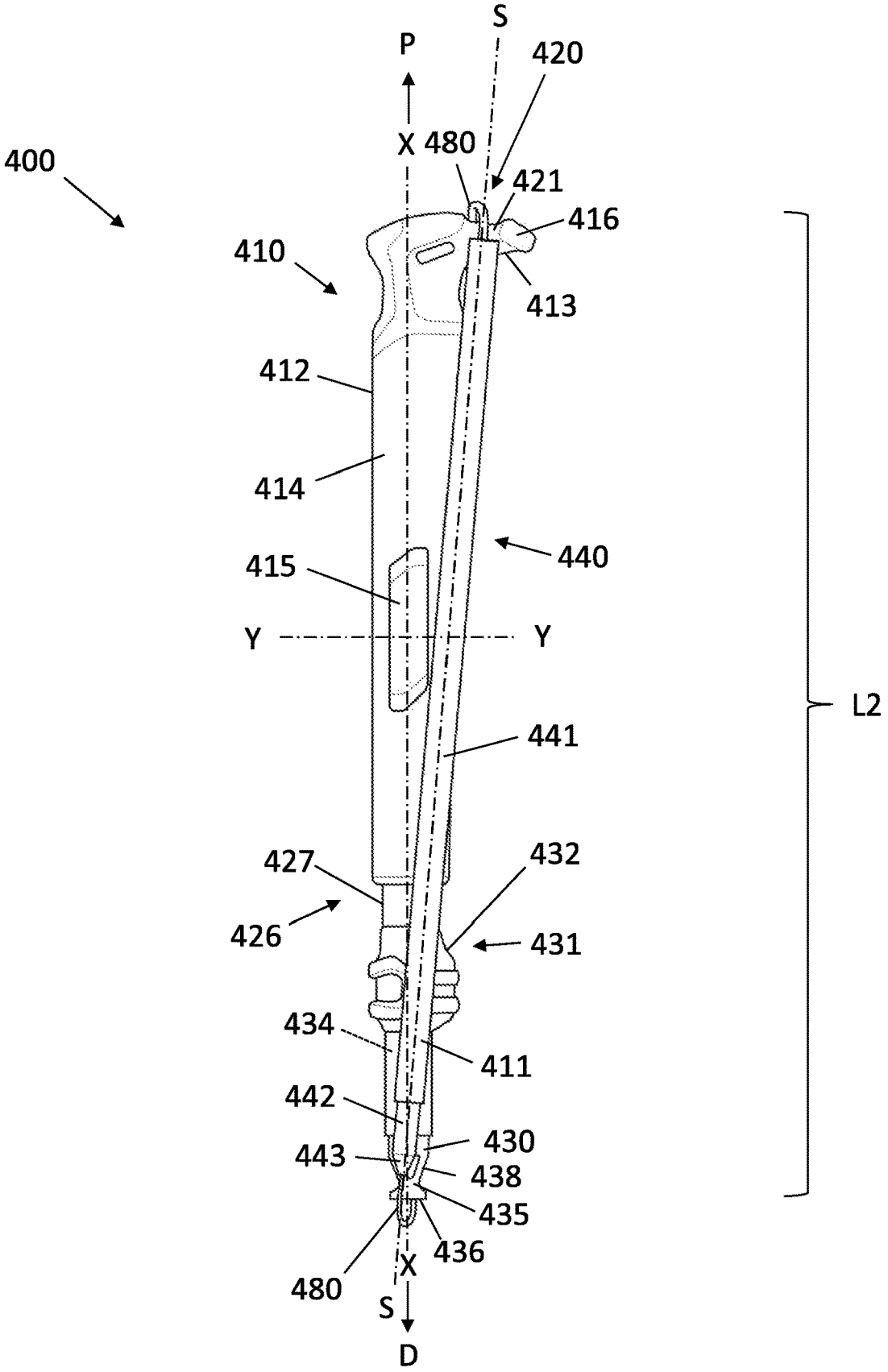
FIG. 6 depicts a side view of another exemplary pole in a collapsed configuration.
Figure 7:
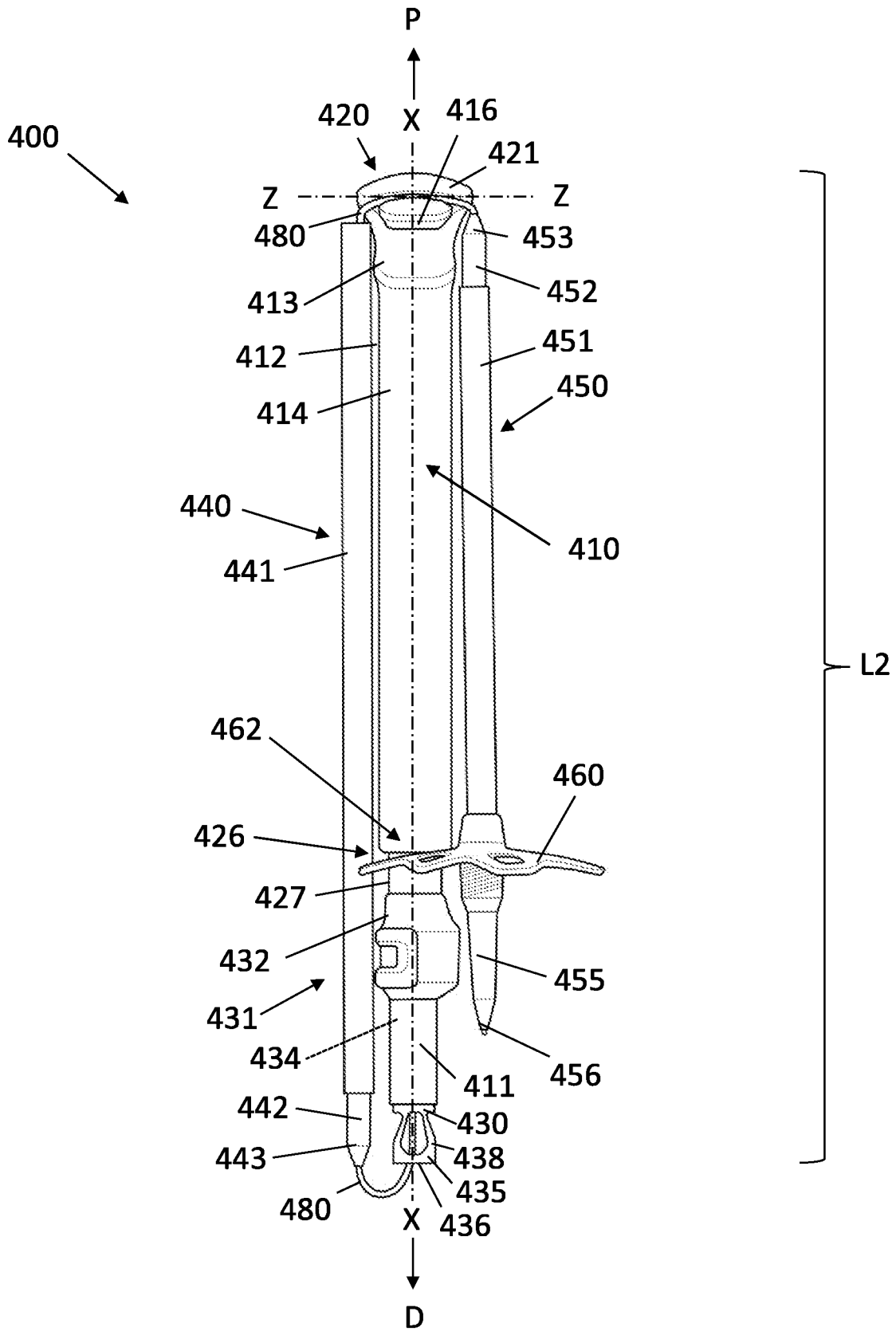
FIG. 7 depicts another side view of the FIG. 6 pole in the collapsed configuration.

As shown in FIGS. 6 and 7, pole apparatus 400 may similarly comprise a grip segment 410, a pole segment 440, a tip segment 450, and a cord 480.

Grip segment 410 may comprise a frame 411, a hand grip 412, a cord attachment portion 420, a tip segment attachment portion 426, an extendable section 430, and a locking mechanism 431 with a platform 432. Frame 411 may similarly comprise a tube or other elongated structure that extends at least partially along a longitudinal axis X-X between distal and proximal ends of grip segment 410. Frame 411 may have a constant diameter along axis X-X. Hand grip 412 may comprise a different set of exterior surfaces, such as: (i) upper bolster surfaces 413 for the upper digits; (ii) grip surfaces 414 for the palm; and (iii) indented surfaces 415 for the tips of the digits when wrapped around grip surfaces 414 about longitudinal axis X-X.

Figure 8:
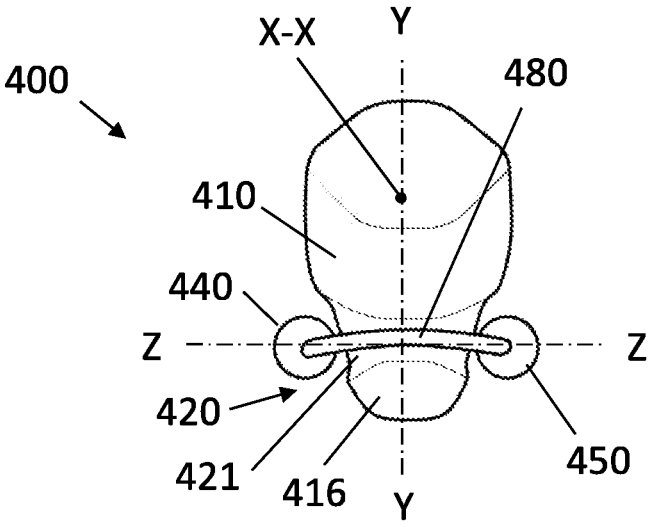
FIG. 8 depicts a top-down view of the FIG. 6 pole in the collapsed configuration.

Cord attachment portion 420 may be located on or adjacent hand grip 412. As shown in FIGS. 6 and 7, attachment 420 may be located at the proximal end of grip segment 410 and comprise one or more cord attachment surfaces 421 attachable with a portion of cord 480 when positioned thereon. The proximal end of grip segment 410 may comprise an extension 416 extending outwardly from longitudinal axis X-X along a lateral axis Y-Y, and the one or more cord attachment surfaces 421 may located on extension 416 and offset from axis X-X. As shown in FIG. 6, the one or more cord attachment surfaces 421 may define a channel that is recessed from hand grip 412 along longitudinal axis X-X and generally parallel with a lateral axis Z-Z. As shown in FIGS. 7 and 8, lateral axis Z-Z and thus the channel defined by surfaces 421 may be offset from axis X-X along lateral axis Y-Y.

Tip segment attachment portion 426 may be located on or adjacent hand grip 412. As shown in FIGS. 6 and 7, attachment 426 may be located near a distal end of frame 411 and comprise the one or more tip attachment surfaces 427 that are attachable with one or more corresponding grip attachment surfaces of tip segment 450. As shown in FIG. 5, the one or more tip attachment surfaces 427 may be defined by an exposed portion of frame 411 comprising a circular cross-section extending along longitudinal axis X-X between hand grip 412 and a platform 432 of locking mechanism 431.

Extendable section 430 may be similarly operable (e.g., telescopically) to define a stowed length L2 and an extended length L3 for grip segment 410 (e.g., as shown in FIG. 1 with respect to apparatus 100). As shown in FIGS. 6 and 7, extendable section 430 may comprise: a receiving structure 435 defining a proximal opening 436 extending into a cavity 434 of grip segment 410; and one or more connecting elements 438 spanning between cavity 434 and opening 436. Receiving structure 435 may be configured to direct an extension 442 of pole segment 440 into cavity 434. For example, opening 436 may be sized to receive extension 442, and interior surfaces of connecting elements 438 may interact with exterior surfaces of a conical tip 443 of extension 442 for guidance into opening 436 and cavity 434.

Figure 9:
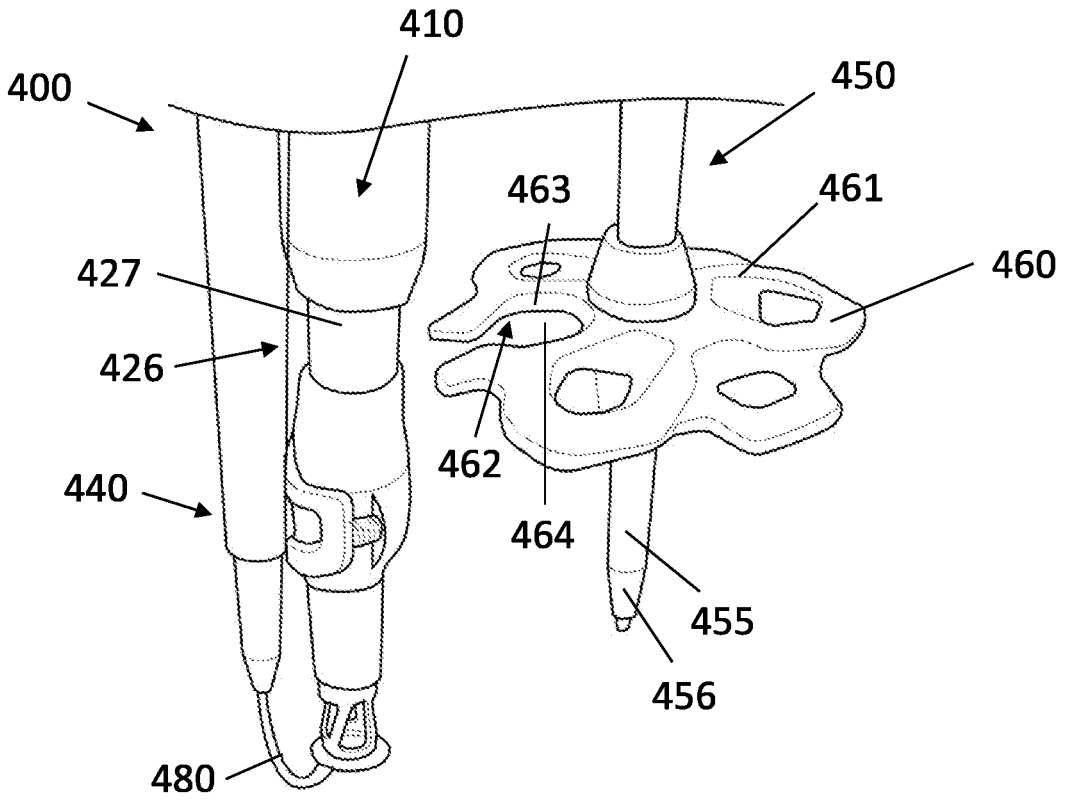
FIG. 9 depicts an exploded view of a distal end of the FIG. 6 pole in the collapsed configuration.

As shown in FIG. 9, tip segment 450 may comprise a tip extension 455, a ground contact tip 456, and a basket 460. For example, basket 460 may comprise web structure 461 defining an attachment opening 464 having a cross-section corresponding with the cross-section of the one or more tip attachment surfaces 427. Attachment opening 464 may comprise a circular cross-section larger than the circular cross section of the one or more tip attachment surfaces 427, allowing surfaces 427 to be snapped in opening 464 when pole apparatus 400 is placed into the collapsed configuration. The circular cross-sections of opening 464 and surfaces 427 may be configured to reduce stresses caused by repeatedly deflecting web structure 461, potentially extending its useful life. As shown in FIGS. 6 and 8, the offset distance between longitudinal axis X-X and lateral axis Z-Z along lateral axis Y-Y may cause segments 440 and 450 to extend along a segment axis X-X that is non-parallel with segment 410 and longitudinal axis X-X when pole apparatus 400 is in the collapsed configuration, increasing the tensile forces applied by cord 480 so as to better maintain the side-by-side disposition.

Figure 10:
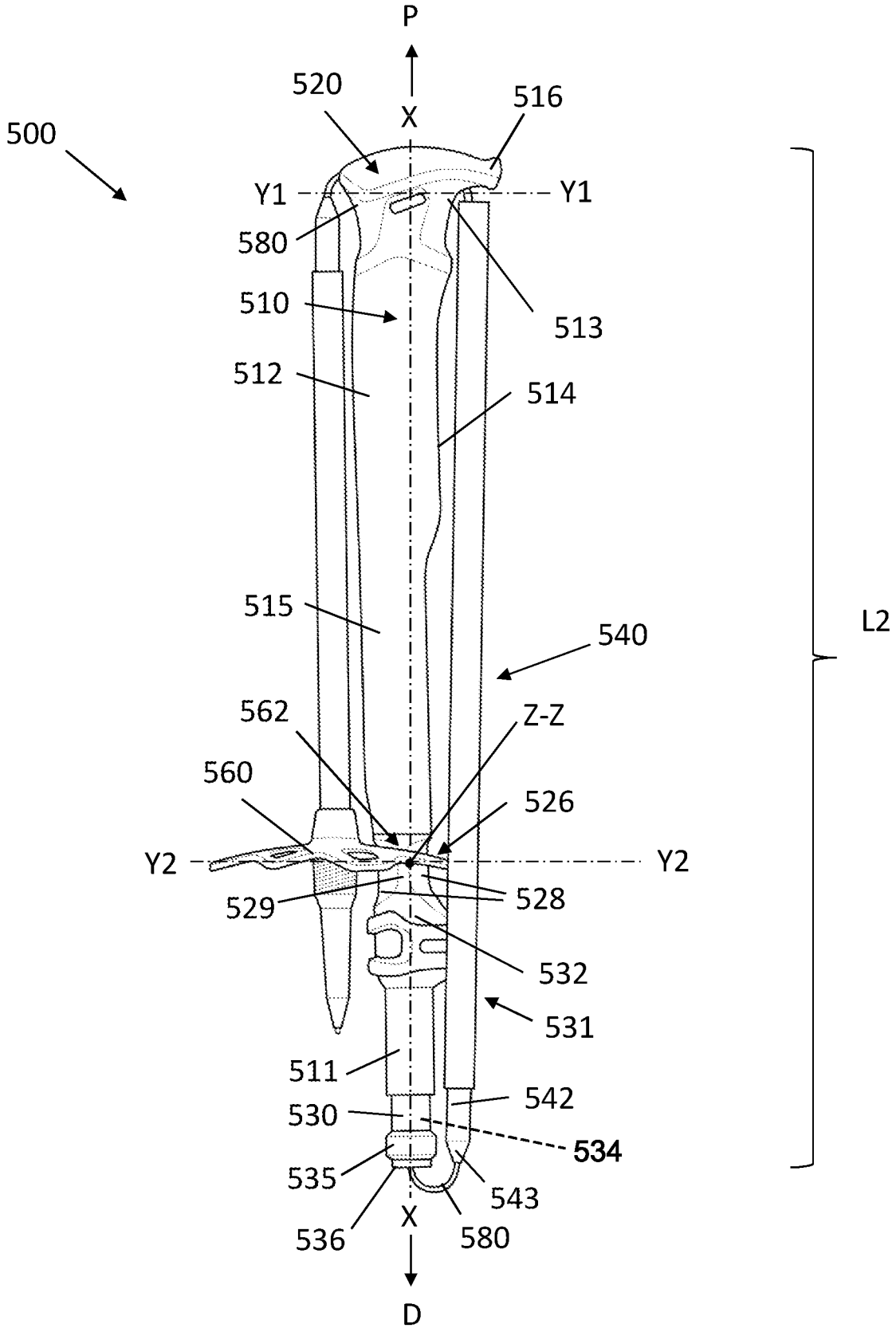
FIG. 10 depicts a side view of another exemplary pole in a collapsed configuration.
Figure 11:
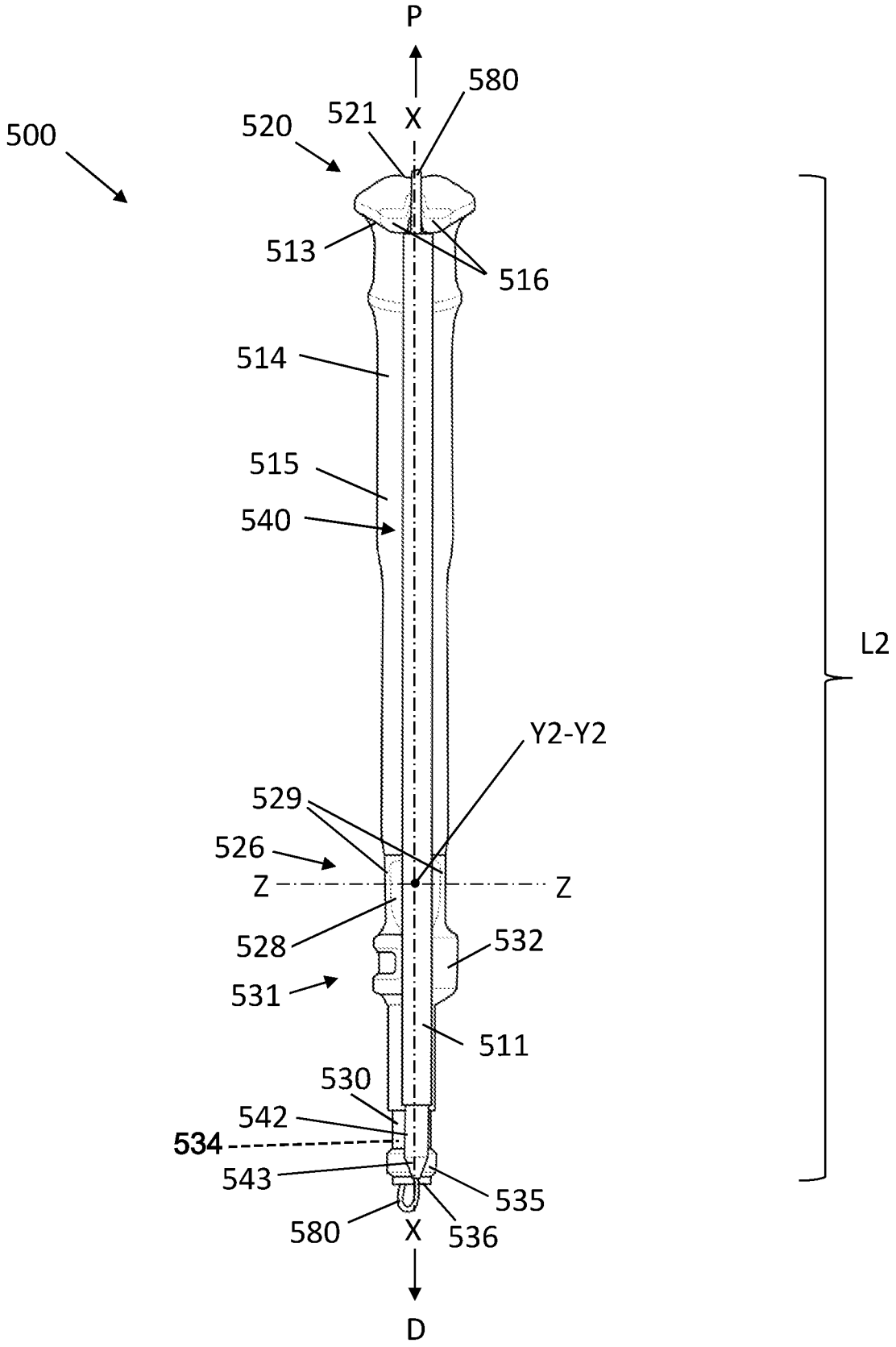
FIG. 11 depicts another side view of the FIG. 10 pole in the collapsed configuration.

As shown in FIGS. 10 and 11, pole apparatus 500 may similarly comprise a grip segment 510, a pole segment 540, a tip segment 550, and a cord 580.

Grip segment 510 may comprise a frame 511, a hand grip 512, a cord attachment portion 520, a tip segment attachment portion 526, an extendable section 530, and a locking mechanism 531 with a platform 532. Frame 511 may comprise a tube or other elongated structure with a constant or variable dimension extending along longitudinal axis X-X. As shown in FIG. 10, hand grip 512 may comprise: (i) upper bolster surfaces 513 for the upper digits; (ii) grip surfaces 514 for the palm; and (iii) additional grip surfaces 515 for the palm and digits.

Figure 12:
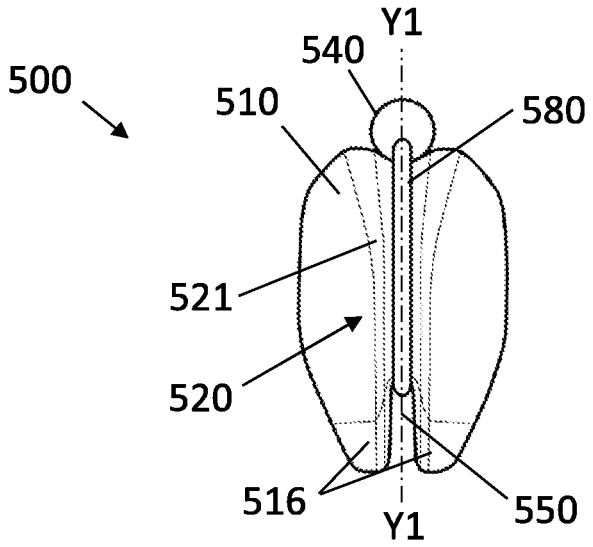
FIG. 12 depicts a top-down view of the FIG. 10 pole in the collapsed configuration.

Cord attachment portion 520 may be located on or adjacent hand grip 512. As shown in FIGS. 10 and 11, attachment 520 may be located at the proximal end of grip segment 510 and comprise one or more cord attachment surfaces 521 attachable with a portion of cord 580 when positioned thereon. The proximal end of grip segment 510 may comprise arms 516 extending outwardly from longitudinal axis X-X along a first lateral axis Y1-Y1. The one or more cord attachment surfaces 521 may comprise or define a recessed channel extending along first lateral axis Y1-Y1. A portion of the channel defined by the one or more cord attachment surfaces 521 may extend between and/or comprise interior surfaces of arms 516, allowing cord 580 to be located therebetween. As shown in FIGS. 11 and 12, a depth of that portion of the channel may be long enough along first lateral axis Y1-Y1 to trap cord 580 between arms 516 when apparatus 500 is in the collapsed configuration.

Figure 13:
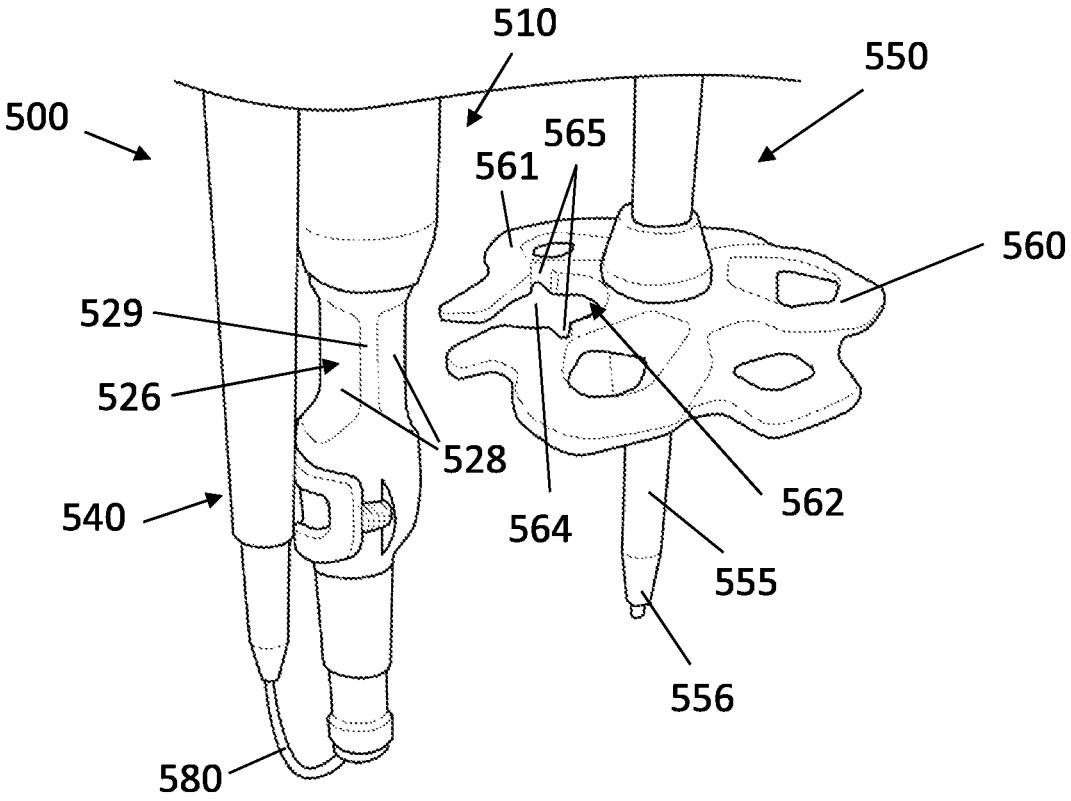
FIG. 13 depicts an exploded view of a proximal end of the FIG. 10 pole in the collapsed configuration.

Tip segment attachment portion 526 may be located on or adjacent hand grip 512. As shown in FIGS. 10, 11, and 13, attachment 526 may be located near a distal end of grip segment 510 and comprise one or more tip attachment surfaces that are attachable with one or more corresponding grip attachment surfaces of tip segment 550. The one or more tip attachment surfaces may be defined by a proximal portion of platform 532 and/or a distal portion of additional grip surfaces 515. For example, the one or more tip attachment surfaces may comprise one or more recessed surfaces 528 spaced apart from another along a second lateral axis Y2-Y2 of grip segment 510, as shown in FIG. 10; and one or more edge surfaces 529 spaced apart from one another along a lateral axis Z-Z of grip segment 510, as shown in FIG. 11. As a further example, the one or more recessed surfaces 528 may be curved about longitudinal axis X-X and edge surfaces 529 may be flush with exterior surfaces of platform 532.

As shown in FIG. 13, tip segment 550 may comprise a tip extension 555, a ground contact tip 556, and a basket 560. For example, basket 560 may comprise a web structure 561 defining an attachment opening 564. Opening 564 may have a cross-section configured to interlock with a cross-section of surfaces 527 to prevent rotation of tip segment 550 relative to grip segment 510. For example, the cross-section of opening 564 may comprise first portions configured to receive recessed surfaces 528 and second portions configured to receive edge surfaces 529. As shown in FIG. 13, the first portions may be curved to match the shape of recessed surfaces 528 and the second portions may comprise indentions 565 corresponding to the shape of edge surfaces. Portions of web structure 561 may flex so that edge surfaces 529 may be snapped into in indentions 565 and thus operable to resist rotational movements of segment 550 relative to segment 510.

Extendable section 530 may be similarly operable (e.g., telescopically) to define a stowed length L2 and an extended length L3 for grip segment 510 (e.g., as shown in FIG. 1 with respect to apparatus 100). Extendable section 530 of pole apparatus 500 may comprise a reinforcing ring 535 and an opening 536 extending into a cavity 534 of grip segment 510. As shown in FIG. 10, opening 536 may be configured to direct an extension 542 of pole segment 540 into cavity 534. Reinforcing ring 535 may be fit over a distal end of extendable section 530 to resist deformations of opening 536 caused by repeated insertions of extension 542 and tip 543 over time, increasing the durability of pole apparatus 500.

Figure 14:
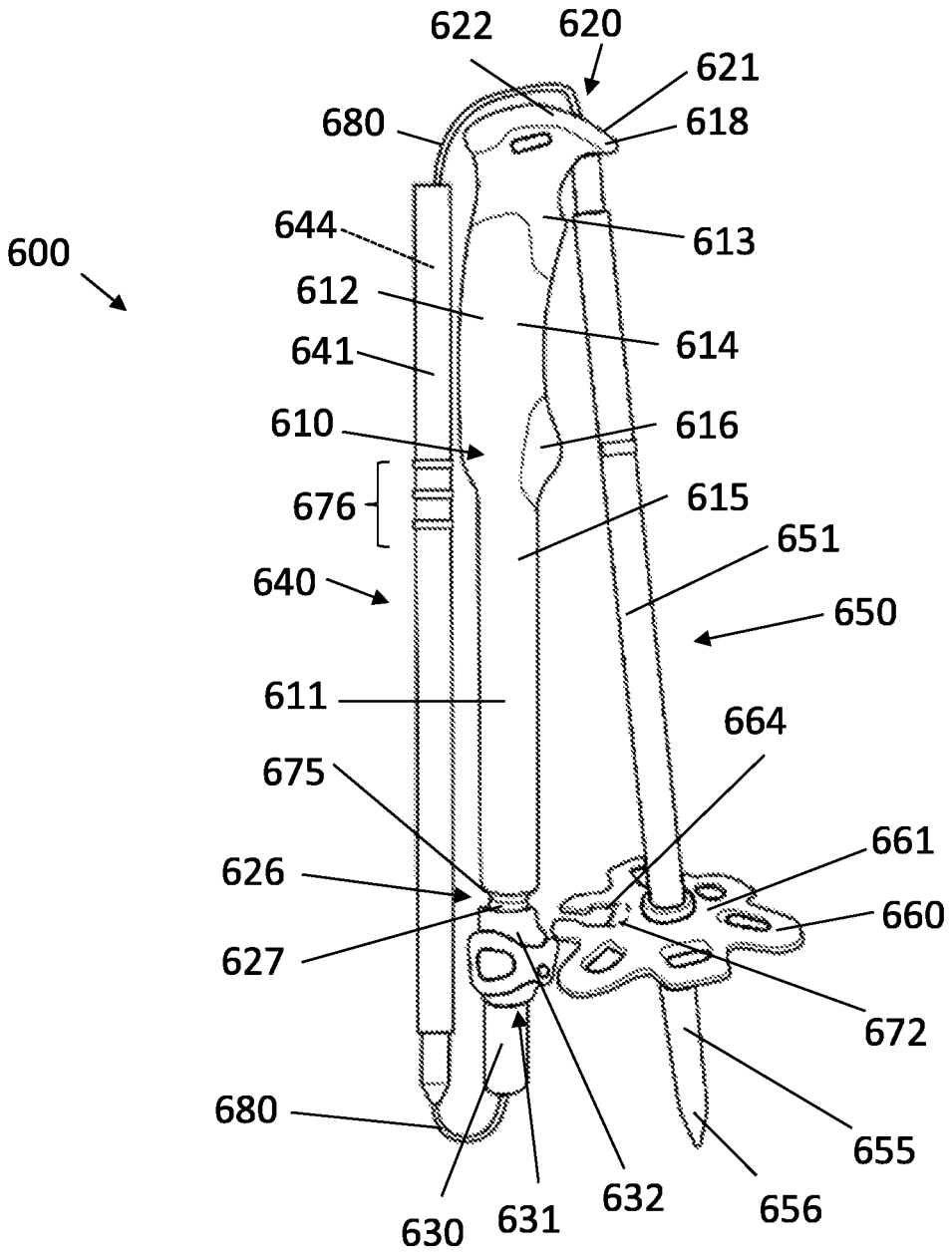
FIG. 14 depicts a mid-assembly view of another exemplary pole in a collapsed configuration.
Figure 15:
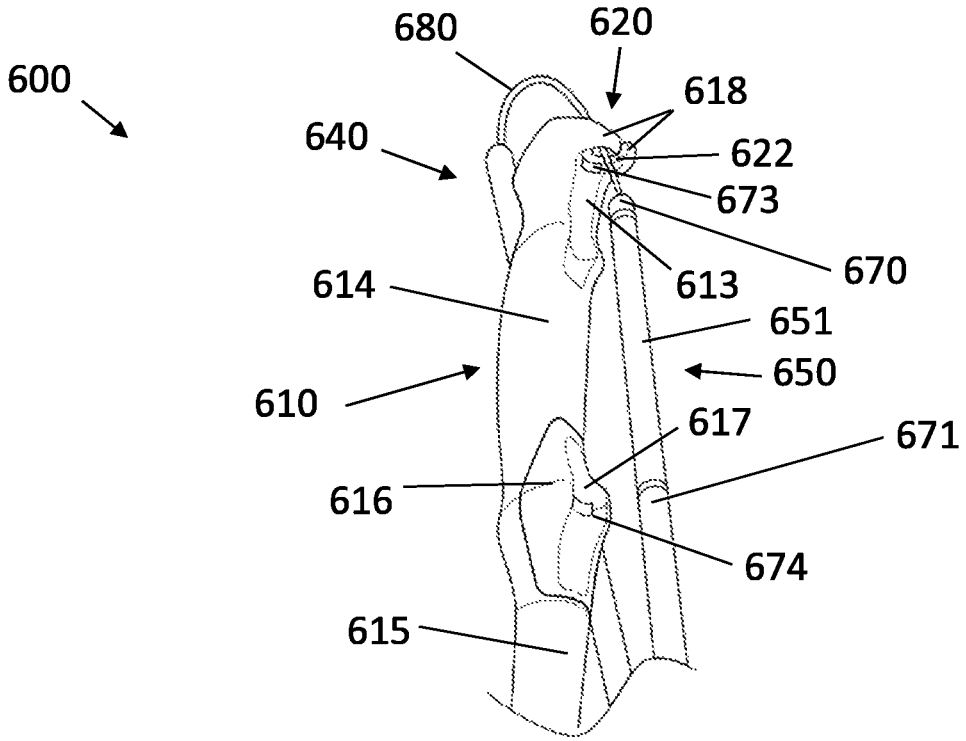
FIG. 15 depicts an exploded view of a proximal end of the FIG. 14 pole in the collapsed configuration.

As shown in FIGS. 14 and 15, pole apparatus 600 may similarly comprise a grip segment 610, a pole segment 640, a tip segment 650, and a cord 680.

Grip segment 610 may comprise a frame 611, hand grip 612, a cord attachment portion 620, a tip segment attachment portion 626, an extendable section 630, and a locking mechanism 631 with a platform 632. Frame 611 may comprise a tubular structure. As shown in FIG. 14, hand grip 612 may comprise: (i) upper bolster surfaces 613 for upper digits of a hand; (ii) grip surfaces 614 for a palm of the hand; and (iii) additional grip surfaces 615 for the hand.

Grip segment 610 also may comprise a side attachment 616 attachable with pole segment 640 and/or tip segment 650. As shown in FIGS. 14 and 15, side attachment 616 may comprise a pair of walls protruding outwardly from frame 611 and/or hand grip 612 to define a channel 617 configured to receive and/or retain a length of a frame 651 (e.g., a tube) of tip segment 650. The walls forming channel 617 may be sized to prevent frame 651 of tip segment 650 from moving laterally relative to frame 611 of grip segment 610 when apparatus 600 is in the collapsed configuration. The walls forming channel 617 may be sized relative to and configured to obtain a snap-fit with exterior surfaces of frame 651. As also shown in FIG. 15, another side attachment (e.g., similar to attachment 616) may be located on and/or adjacent upper bolster surfaces 613. Similar side attachments also may be provided for pole segment 640 in keeping with these examples.

Cord attachment portion 620 may be located on or adjacent hand grip 612. As shown in FIG. 14, cord attachment portion 620 may be located at the proximal end of grip segment 610 and comprise one or more cord attachment surfaces 621 attachable with a portion of cord 680 when positioned thereon. The proximal end of grip segment 610 may comprise arms 618 extending outwardly from cord attachment portion 620. For example, the one or more cord attachment surfaces 621 of portion 620 may comprise or define a channel extending between interior surfaces of arms 618, allowing cord 680 to be located and/or trapped therebetween. As shown in FIG. 15, the interior surfaces of arms 618 may define a catch 622 configured to receive and retain the proximal end of tip segment 650. For example, catch 622 may comprise a circular cross-section that is configured to receive a circular cross-section of frame 651, allowing the proximal end of tip segment 650 to be more closely secured against grip segment 610 and/or maintained side-by-side therewith.

Tip segment attachment portion 626, extendable section 630, and locking mechanism 631 with platform 632 are shown in FIGS. 14 and 15 as being similar to their counterpart elements described above. For example, similar to tip segment attachment portion 426, tip segment attachment portion 626 may comprise tip attachment surfaces 627 having a generally circular cross-section. As shown in FIG. 14, pole segment 640 may comprise a frame 641 (e.g., a tube) extending along longitudinal axis X-X between the proximal and distal ends of pole segment 640 and tip segment 650 may comprise a tip extension 655, a ground contact tip 656, and a basket 660. For example, basket 660 may comprise a web structure 661 defining an attachment opening 664 engageable with tip attachment surfaces 627 of tip segment attachment portion 626. As shown in FIG. 14, opening 664 may comprise an open cross-section that is configured to receive the generally circular cross-section of tip attachment surfaces 627, allowing the distal end of tip segment 650 to be structurally secured against and maintained side-by-side with grip segment 610 when pole apparatus 600 is in the collapsed configuration.

Various elements of grip segment 610, pole segment 640, and/or tip segment 650, such as cord attachment portion 620, tip attachment portion 626, side attachment 616, arms 618, catch 622, and/or basket 660, may be further configured to prevent frame 651 from moving laterally when apparatus 600 is in the collapsed configuration. As shown in FIGS. 14 and 15, magnetic interactions between portions of grip segment 610, pole segment 640, and/or tip segment 650 may be utilized to obtain and maintain the side-by-side disposition of segments 610, 640, and 650. For example, magnetic interactions between frame 651, side attachment 616, catch 622, and/or basket 600 may be utilized to prevent frame 651 from moving laterally by providing resisting forces in addition to those provided by structural interactions between frame 651 and the above-described structures of cord attachment portion 620, tip attachment portion 626, side attachments 616, arms 618, catch 622, and/or basket 600.

As shown in FIG. 14, tip segment 650 may comprise one or more first magnetic elements, including a magnetic element 670, a magnetic element 671, and/or a magnetic element 672. Grip segment 610 may comprise one or more corresponding magnetic elements, including a magnetic element 673, a magnetic element 674, and/or a magnetic element 675. Magnetic elements 670-672 may comprise magnets (e.g., such as rare earth magnets) and/or metal portions of elements of tip segment 650 (e.g., of frame 651). Magnetic elements 673-675 may comprise corresponding magnets (e.g., rare earth magnets) and/or metal portions of grip segment 610 (e.g., of frame 611). As shown in FIG. 14, magnetic elements 670-672 and 673-675 be positioned adjacent one another when transitioning pole apparatus 600 to the collapsed configuration to generate magnetic forces for maintaining a side-by-side disposition of segments 610, 640, and 650.

As shown in FIG. 15, magnetic element 670 may be located at a proximal end of tip segment 650 and corresponding magnetic element 673 may be located at a proximal end of grip segment 610. For example, magnetic element 670 may comprise a metal plate or ring contained in the circular cross-section of frame 651; and magnetic element 673 may comprise a magnet (e.g., a rare earth magnet) that is embedded in one or both of arms 618, adjacent the circular cross-section of catch 622. When placed adjacent one another, as shown in FIG. 14, magnetic elements 670 and 673 may generate magnetic forces that pull the proximal end of tip segment 650 into catch 622, allowing the proximal end of tip segment 650 to be structurally and/or magnetically aligned with, secured against, and maintained side-by-side with grip segment 610.

As also shown in FIG. 15, magnetic element 671 may be located at a central portion of tip segment 650 and corresponding magnetic element 674 may be located at a central portion of grip segment 610. For example, magnetic element 671 may comprise a metal plate or ring contained in the circular cross-section of frame 651; and magnetic element 674 may comprise a magnet (e.g., a rare earth magnet) embedded in a portion of channel 617, such as in one or both of the walls forming channel 617. When placed adjacent one another, as shown in FIG. 14, magnetic elements 671 and 674 may generate magnetic forces that pull the central portion of tip segment 650 into channel 617, allowing the central portion of tip segment 650 to be structurally and/or magnetically aligned with, secured against, and maintained side-by-side with grip segment 610.

As shown in FIG. 14, magnetic element 672 may be located at a distal portion of tip segment 650, such as basket 660, and corresponding magnetic element 675 may be located at a distal portion of grip segment 610. For example, magnet element 672 may comprise a magnet (e.g., a rare earth magnet) embedded in web structure 661 at location adjacent attachment opening 664; and magnet element 675 may comprise a metal plate or ring contained in the generally circular cross-section of surfaces 627 of tip segment attachment portion 626. When placed adjacent one another, as shown in FIG. 14, magnetic elements 672 and 675 may generate magnetic forces that pull surfaces 627 into opening 664, allowing the distal end of tip segment 650 to be structurally and/or magnetically aligned with, secured against, and maintained side-by-side with the distal end of grip segment 610.

In each of these examples, a first magnetic element (e.g., one of 670, 671, and 672) may be operable with a second magnetic element to generate a magnetic force that prevent frame 651 from moving laterally relative to side attachment 616, catch 622, and/or basket 660 unless the user applies a predetermined minimum amount of disruptive force to frame 651 to transition pole apparatus 600 into the expanded configuration. Although shown as being embedded in FIGS. 14 and 15, surfaces of any one of magnetic elements 670-675 also may be exposed or flush with exterior surfaces of grip segment 610 and/or tip segment 650. Although not shown in FIGS. 14, and 15, pole segment 640 may similarly comprise magnetic elements allowing for similar attachments to grip segment 610 and/or tip segment 650.

Any one of pole segments 610, 640, and/or 650 also may comprise magnetic elements operable to attach pole apparatus 600 to another object when in the collapsed configuration. As shown in FIG. 14, pole segment 640 may comprise one or more magnetic elements 676 that are positioned away from magnetic elements 670-675 when pole apparatus 600 is in the collapsed configuration and thus operable to magnetically attach apparatus 600 to an object. The magnetic forces generated between magnetic elements 670-675 may be balanced against the magnetic forces generated with magnet elements 676 so that pole apparatus 600 may be removed from the object without transitioning out of the collapsed configuration. Each magnetic element 676 may comprise a metal plate or ring, or a magnet (e.g., a rare earth magnet), contained in a generally circular cross-section of frame 641. The object may be a sliding apparatus comprising a top surface, a glide surface, and magnetic elements that are located between top and bottom surfaces and operable to removably attach accessories to the top and/or bottom surfaces. For example, the sliding apparatus may comprise any number of magnets and/or related couplers or structures configured to magnetically attach at least one pole apparatus 600 to the sliding apparatus, including those described in U.S. Pat. No. 10,695,652, to Shute, et al., the entirety of which is hereby incorporated by reference into this application and thus part of this disclosure.

The object also may be a backpack, garment, safety item, and/or storage element comprising one or more magnetic elements corresponding with one or more magnetic elements 676 to removably attached pole apparatus 600 thereto. Any other objects may be similarly bundled together with pole apparatus 600 utilizing magnetic elements 676 without disrupting the side-by-side disposition of grip segment 610, pole segment 640, and tip segment 650. Because of their position on pole segment 740, some objects may be configured to remain attached to pole segment 640 even after pole apparatus 600 is transitioned to the extended configuration. For example, the object also may comprise a self-contained electronic device (e.g., a camera, a light, and/or a sensor) that is removably attachable to pole segment 640 using a structural connection between frame 641 and/or a magnetic interaction with magnet elements 676.

Figure 16:
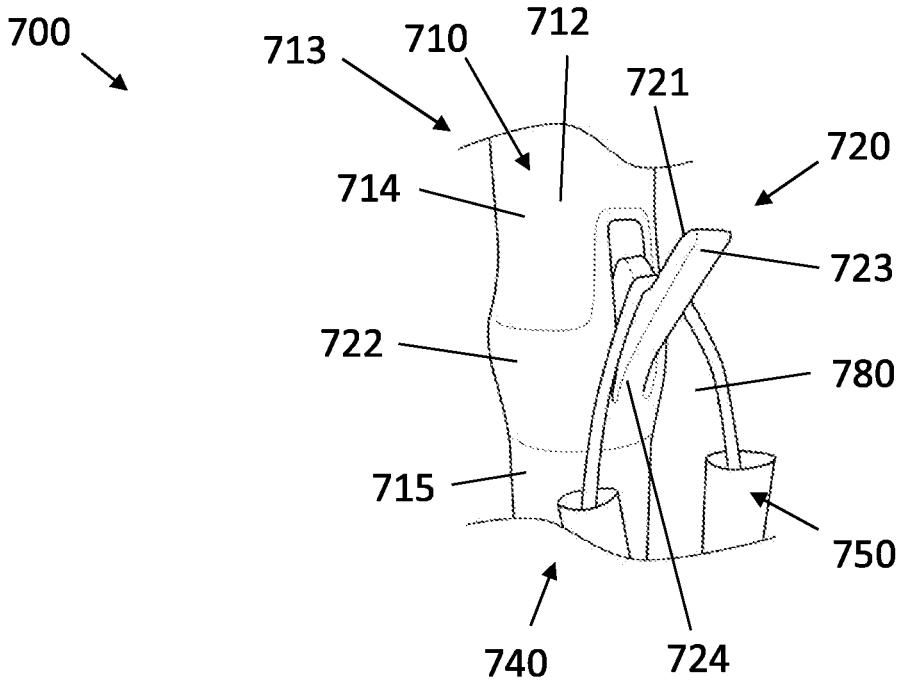
FIG. 16 depicts another exemplary pole including an exemplary cord attachment portion in an extended position.

As shown in FIG. 16, pole apparatus 700 may similarly comprise a grip segment 710, a pole segment 740, a tip segment 750, and a cord 780.

Figure 17:
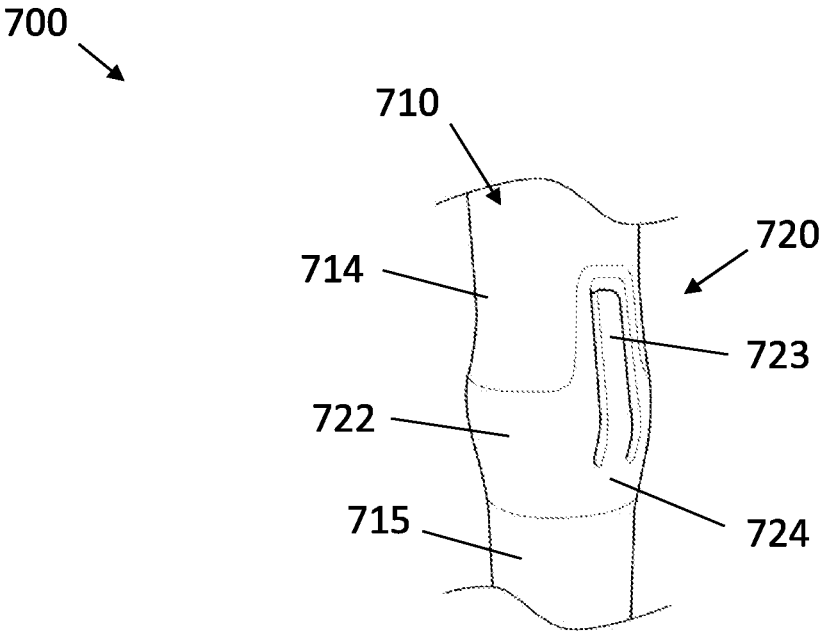
FIG. 17 depicts the FIG. 16 cord attachment portion in a retracted position.

Grip segment 710 may comprise a cord attachment portion 720 located on or adjacent a hand grip 712. In keeping with above, hand grip 712 may comprise: (i) an upper bolster surface 713; (ii) a grip surface 714; and (iii) additional grip surfaces 715. Attachment 720 may be located between grip surface 714 and additional grip surfaces 715. For example, cord attachment portion 720 may comprise an arm platform 722 and at least one arm 723 that is movable relative to platform 722 between an extended position shown in FIG. 16 and a retracted position shown in FIG. 17. Each arm 723 may be configured to position a cord attachment surface 721 relative to cord 780. The cord attachment surface 721 may located on an interior of arm 723 and configured to define a channel configured to receive a portion of cord 780. Each arm 723 may be rotatably attached to arm platform 722 with a hinge 724 operable to position the cord attachment surface 721. Hinge 724 may comprise a living hinge and/or a biasing element (e.g., such as spring) that bias arm 723 toward the retracted position to pinch or trap the portion of cord 780 against segment 710 with the cord attachment surface 721.

Figure 18:
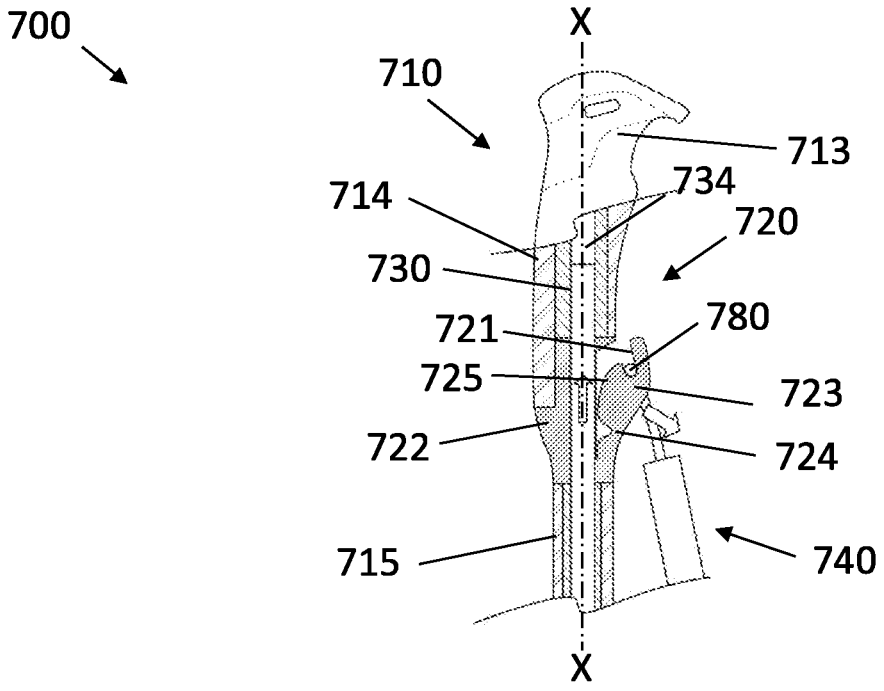
FIG. 18 depicts a cross-sectional view of the FIG. 16 cord attachment portion in the extended position.
Figure 19:
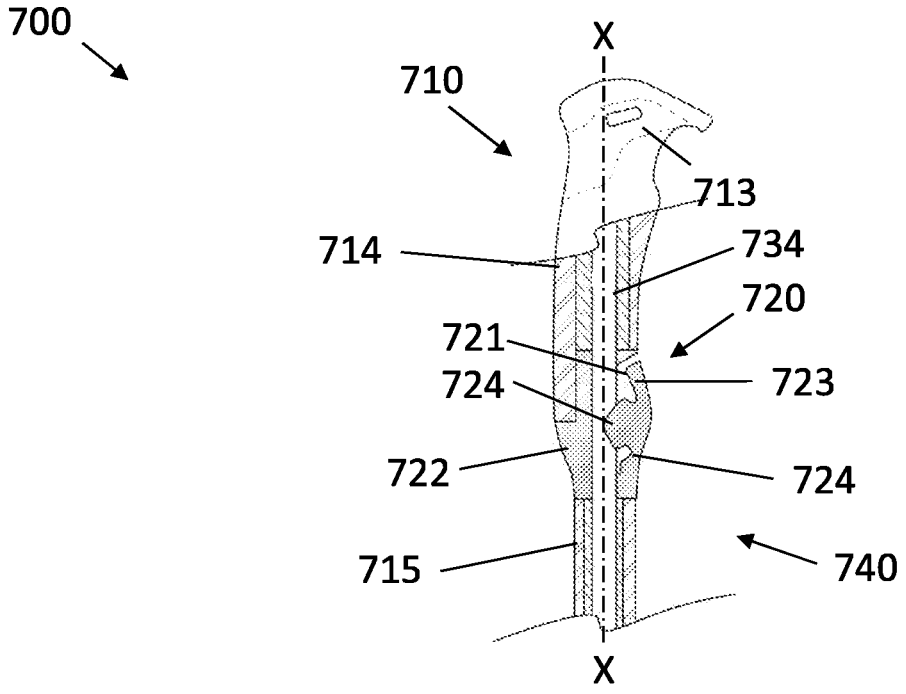
FIG. 19 depicts a cross-sectional view of the FIG. 17 cord attachment portion in the retracted position.

As show in FIG. 18, grip segment 710 of pole apparatus 700 also may comprise an extendable section 730 that is similarly operable (e.g., telescopically) to define a stowed length L2 and an extended length L3 for grip segment 710 (e.g., as shown in FIG. 1 with respect to apparatus 100). As before, grip segment 710 may comprise a cavity 734 and extendable section 730 may be receivable in cavity 734 along longitudinal axis X-X to define stowed length L2. As shown in FIG. 18, an attachment surface 725 of arm 722 may extend into cavity 734 and/or curve outwardly toward longitudinal axis X-X. Attachment surface 725 may be biased into cavity 734 by hinge 724 of arm 723. Moving extendable section 730 proximally along longitudinal axis X-X inside of cavity 734 to realize length L2 may cause arm 723 to move into the extended position. For example, the proximal end and exterior surfaces of extendable section 730 may interact with attachment surface 725 to rotate arm 723 about hinge 724 into the extended position whenever section 730 is retracted into grip segment 710. Hand grip 712 and arm platform 722 may comprise different materials. For example, surfaces 714 and 715 of grip 712 may comprise a soft polymeric material configured to minimize force transfer and platform 722 may comprise a rigid polymeric material configured for durability.

Figure 20:
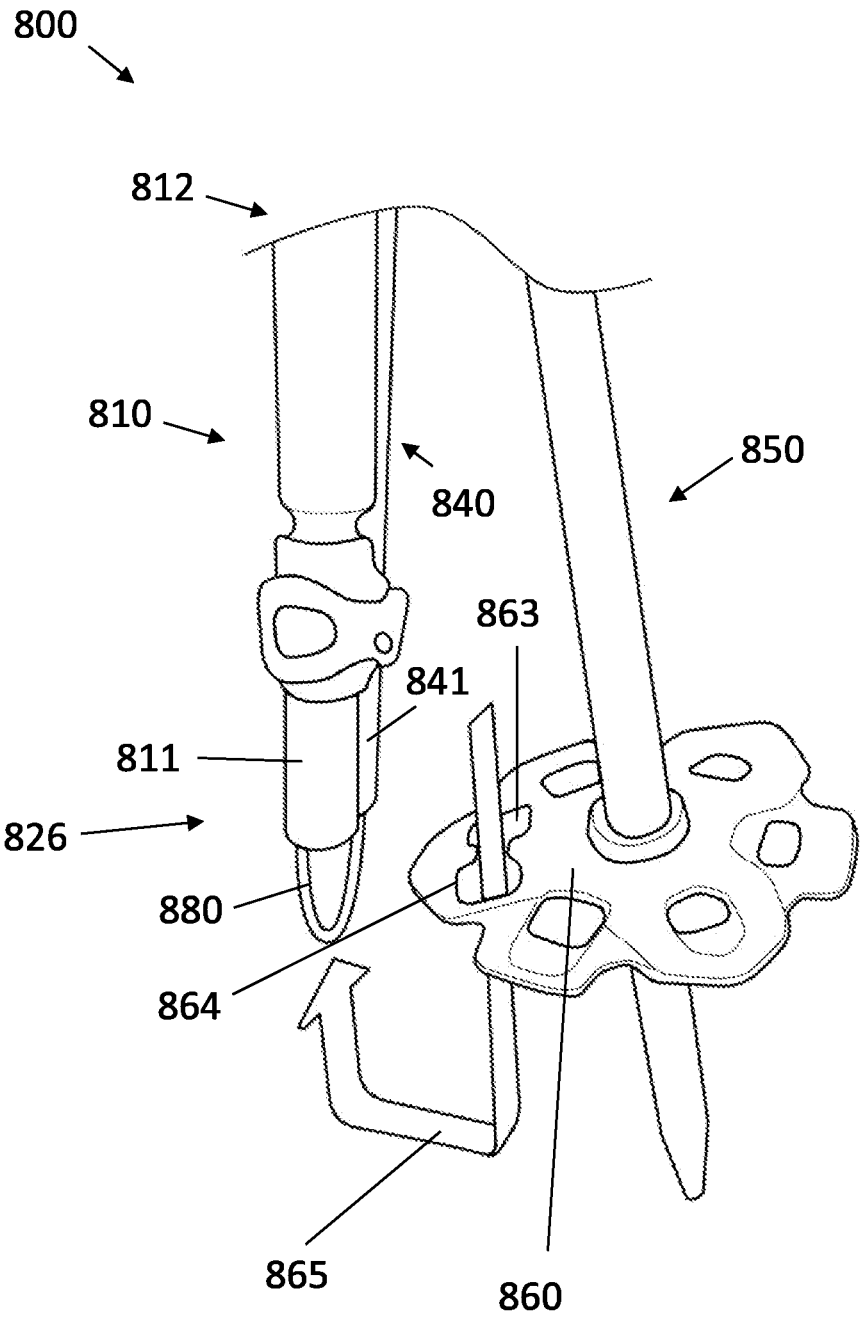
FIG. 20 depicts a mid-assembly view of a distal end of another exemplary pole.

As shown in FIG. 20, pole apparatus 800 may similarly comprise a grip segment 810, a pole segment 840, a tip segment 850, and a cord 880.

Grip segment 810 may comprise a frame 811, a hand grip 812, and a tip segment attachment portion 826. Pole segment 840 may comprise a frame 841. A distal end of grip segment 810 may be defined by frame 811, a proximal end of pole segment 840 may be defined by frame 841, and tip segment attachment portion 826 may comprise an outer perimeter of the respective ends of segments 810 and 840 when placed in the side-by-side disposition shown in FIG. 20. For example, tip segment 850 may comprise a basket 860 defining an attachment opening 864 configured to receive the distal end of frame 811 together with the proximal end frame 841. An exemplary path of movement 865 is shown in FIG. 20, along which basket 860 may be moved distally and laterally to position opening 864 under the respective ends of frames 811 and 841, and then proximally to receive each end within opening 864. As also shown in FIG. 20, attachment opening 864 may comprise a first section (at left) sized to wrap around the distal end of frame 811 and a second section (at right) sized to wrap around the end of frame 841 so as to provide a tighter fit between grip segment 810 and tip segment 850.

Figure 21:
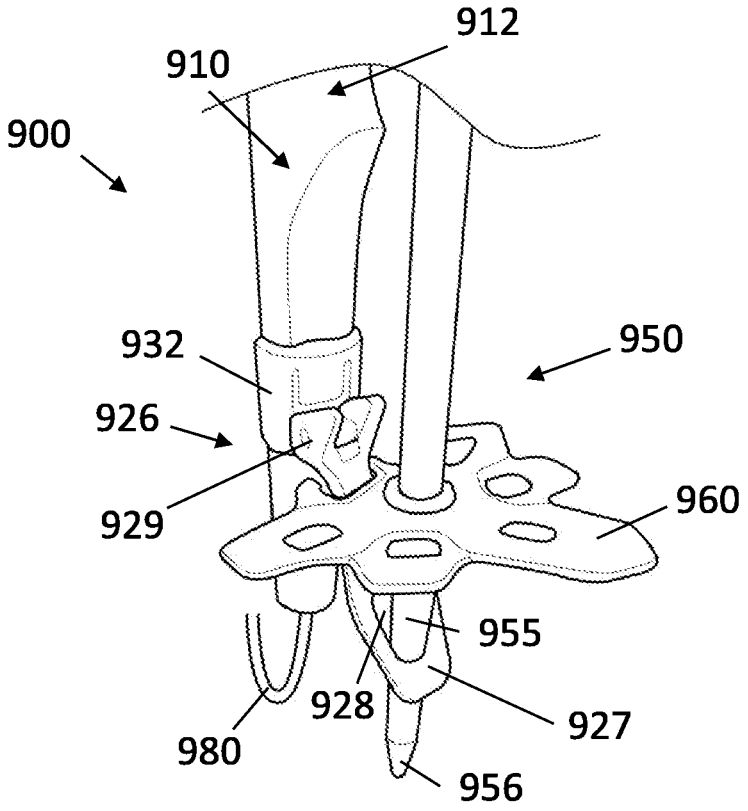
FIG. 21 depicts an assembled view of an exemplary tip segment attachment portion comprising a catch located at a distal end of another exemplary pole.

As shown in FIG. 21, pole apparatus 900 may similarly comprise a grip segment 910, a pole segment (e.g., similar to above), a tip segment 950, and a cord (e.g., also similar to above).

Figure 22:
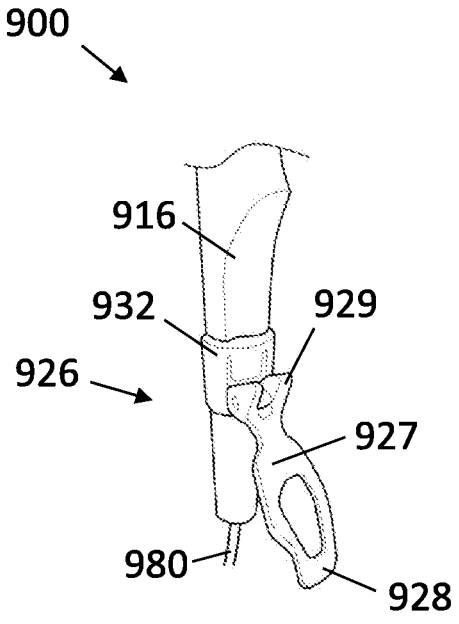
FIG. 22 depicts the FIG. 21 catch in an extended position.
Figure 23:
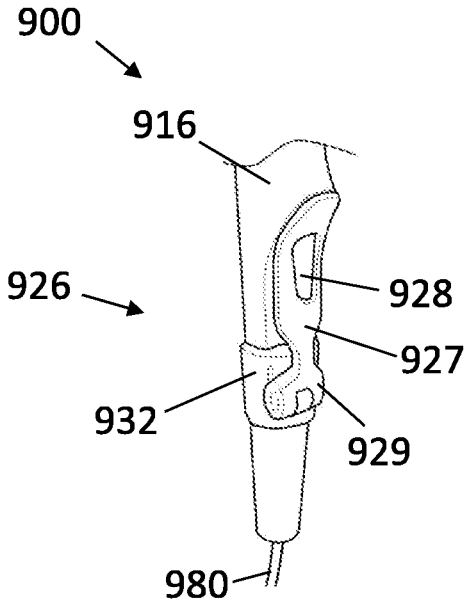
FIG. 23 depicts the FIG. 21 catch in a retracted position.

Grip segment 910 may comprise a hand grip 912 with various exterior surfaces, a platform 932, and a tip segment attachment portion 926. As shown, tip segment attachment portion 926 may comprise a catch 927 that is rotatably mounted on platform 932; and tip segment 950 may comprise a tip extension 955, a ground contact tip 956, and a basket 960. Catch 927 may be rotatably mounted to platform 932 with a hinge 929 and comprise an opening 928 sized to receive tip extension 955 and ground contact tip 956. Because of hinge 929, tip segment attachment portion 926 may be operable between: an extended position shown in FIGS. 21 and 22, where catch 927 is rotated distally about hinge 929 to position opening 928 outwardly from platform 932 to receive tip extension 955 and tip 956 when placing pole apparatus 900 into the collapsed configuration; and a retracted position shown in FIG. 23, wherein catch 927 is rotated proximally about hinge 929 to position opening 928 adjacent platform 932 when apparatus 900 is in the expanded configuration.

Aspects of assembly method 200 may be modified to accommodate the above-described differences between pole apparatus 100 and pole apparatus 400, 500, 600, 700, 800, and 900. For example, detaching step 220 may be modified for use with structures of any tip segment attachment portions 426, 526, 626, 726, 826, and/or 926; and detaching step 230 may similarly be modified for use with structures of any cord attachment portions 420, 520, 620, 720, 820, and/or 920. Aspects of disassembly method 300 also may be modified to accommodate the above-described differences. For example, attaching step 350 may be modified for use with structures of any cord attachment portions 420, 520, 620, 720, 820, and/or 920; and attaching step 360 may be modified for use with structures of any tip segment attachment portions 426, 526, 626, 726, 826, and/or 926.

Various aspects have been described herein with reference to pole apparatus 100, 400, 500, 600, 700, 800, and/or 900; and methods 200 and/or 300 performable therewith. The described aspects may allow any of pole apparatus 100, 400, 500, 600, 700, 800, and/or 900 to be transitioned between the expanded and collapsed configurations described above, making each of them expandable for use as a pole (e.g., a ski pole) and collapsible for transit or storage. For example, the different types of cord attachment portions 120, 420, 520, 620, 720, 820, and/or 920 and tip segment attachment portions 126, 426, 526, 626, 726, 826, and/or 926 may be utilized to maintain the collapsed configuration of each apparatus 100, 400, 500, 600, 700, 800, and/or 900 by preventing them from inadvertently transitioning to the expanded configuration and/or a partially expanded configuration.

As a further example, the described attachments also may be operable with any of cords 180, 480, 580, 680, 780, 880, and/or 980 to further maintain the collapsed configuration and/or reduce the collapsed size of each apparatus 100, 400, 500, 600, 700, 800, and 900 by directing tensile forces applied by any cord 180, 480, 580, 680, 780, 880, and/or 980. As described above with reference to FIGS. 14 and 15, each of pole apparatus 100, 400, 500, 600, 700, 800, and 900 also may utilize any number of magnetic elements positioned to help obtain and maintain the side-by-side disposition of their respective grip, pole, and tip segments, and/or to removably attach any one of pole apparatus 100, 400, 500, 600, 700, 800, and 900 to another object for storage purposes and/or for enhance functionality.

While principles of the present disclosure are described herein with reference to illustrative aspects for particular applications, the disclosure is not limited thereto. Those having ordinary skill in the art and access to the teachings provided herein will recognize additional modifications, applications, aspects, and substitution of equivalents all fall in the scope of the aspects described herein. Accordingly, the present disclosure is not to be considered as limited by the foregoing description.

What is claimed:

1. A pole apparatus comprising:

a grip segment comprising a recessed cord attachment surface;

a pole segment;

a tip segment; and a cord extending between at least the pole segment and the tip segment, wherein:

the grip segment, the pole segment, and the tip segment are arranged in a side-by-side disposition;

a portion of the cord extending between the pole segment and the tip segment is removably attached to the cord attachment surface; and the grip segment is removably attached to the tip segment such that the removable attachment of the grip segment to the tip segment maintains the side-by-side disposition.

2. The apparatus of claim 1, wherein:

the pole segment comprises a plurality of separable pole portions; and the grip segment, the plurality of separable pole portions, and the tip segment are arrangeable in the side-by-side disposition.

3. The apparatus of claim 1, wherein the cord comprises one or more cord segments extending between the grip segment, the pole segment, and the tip segment.

4. The apparatus of claim 1, wherein the cord attachment surface defines a channel or groove receiving the portion of the cord.

5. The apparatus of claim 1, wherein:

the grip segment comprises a lateral extension; and the cord attachment surface is on the lateral extension.

6. The apparatus of claim 5, wherein the cord attachment surface extends across the lateral extension.

7. The apparatus of claim 5, wherein:

the lateral extension comprises a pair of retaining walls; and the cord attachment surface defines a groove extending around a proximal end of the grip segment and between the pair of retaining walls.

8. The apparatus of claim 1, wherein:

the grip segment comprises an extendable arm;

the cord attachment surface is on the extendable arm; and the extendable arm is rotatable to position the cord attachment surface to receive the portion of the cord.

9. The apparatus of claim 1, wherein the grip segment comprises an extendable seat that is removably attachable to a distal end of the tip segment.

10. The apparatus of claim 1, wherein:

the tip segment comprises a basket; and the basket is removably attachable to the grip segment.

11. The apparatus of claim 10, wherein:

the basket comprises a web structure defining an opening operable to receive a distal end of the grip segment; and the web structure is operable to limit a rotation of the tip segment relative to the grip segment when the distal end of the grip segment is received in the opening.

12. The apparatus of claim 11, wherein:

the web structure comprises a first magnetic element;

the distal end of the grip segment comprises a second magnetic element; and the basket is removably attachable, to the grip segment using a magnetic interaction between the first magnetic element and the second magnetic element when the distal end of the grip segment is received in the opening.

13. The apparatus of claim 1, wherein:

the grip segment comprises a first magnetic element;

the tip segment comprises a second magnetic element; and a portion of the grip segment is removably attachable to a portion of the tip segment using a magnetic force generated between the first magnetic element and the second magnetic element when the portion of the grip segment is positioned adjacent the portion of the tip segment.

14. The apparatus of claim 13, wherein the portion of the tip segment comprises a basket that is removably attachable to the portion of the grip segment by the magnetic force generated between the first magnetic element and the second magnetic element.

15. The apparatus of claim 1, wherein the grip segment comprises a tip attachment surface, the tip segment comprises a grip attachment surface, and the grip segment is removably attachable to the tip segment by interlocking the tip attachment surface with the grip attachment surface.

16. The apparatus of claim 15, wherein the grip segment is removably attachable to the tip segment by interlocking one or both of:

a portion of the cord attachment surface with a proximal end of the tip segment; and a central portion of the grip segment with a central portion of the tip segment.

17. The apparatus of claim 15, wherein a portion of the grip segment is magnetically attachable to a portion of the tip segment when the tip attachment surface is interlocked with the grip attachment surface.

18. A pole apparatus comprising:

a grip segment comprising a cord attachment surface;

a pole segment;

a tip segment; and a cord extending between at least the pole segment and the tip segment, wherein:

the grip segment, the pole segment, and the tip segment are arrangeable in a side-by-side disposition;

a portion of the cord extending between the pole segment are arrangeable in a side-by-side disposition;

the grip segment is removeably attachable to the tip segments such that when the portion of the cord is positioned on the cord attachment surface, removable attachment of the grip segment to the tip segment maintains the side-by-side disposition;

the grip segment comprises an extendable arm, a cavity, and an extendable segment that is extendable from and retractable into the cavity;

the cord attachment surface is on the extendable arm;

the extendable arm is rotatable to position the cord attachment surface to receive the portion of the cord; and retracting the extendable segment into the cavity causes a rotation of the extendable arm that positions the cord attachment surface to receive the portion of the cord.

19. A method of maintaining a grip segment, a pole segment, and a tip segment of a pole apparatus in a side-by-side disposition, the pole apparatus further comprising a cord extending between at least the pole segment and the tip segment, and the grip segment comprising a recessed cord attachment surface, the method comprising:

removably attaching a portion of the cord between the pole segment and the tip segment to the cord attachment surface; and removably attaching the tip segment to the grip segment when the portion of the cord is removably attached to the cord attachment surface such that the removable attachment of the grip segment to the tip segment maintains the side-by-side disposition.

20. The method of claim 19, wherein removably attaching the tip segment to the grip segment comprises at least one of:

interlocking a tip attachment surface of the grip segment with a grip attachment surface of the tip segment when the portion of the cord is attached to the cord attachment surface; and generating a magnetic force between a first magnetic element of the grip segment and a second magnetic element of the tip segment.

21. The method of claim 19, wherein removably attaching the portion of the cord to the cord attachment surface comprises receiving the portion of the cord in a channel or groove defined by the cord attachment surface.

* * * * *